US006149153A

United States Patent [19]

Sheats, Jr.

[11] Patent Number: 6,149,153

[45] Date of Patent: Nov. 21, 2000

[54] AUTOMATIC PROPELLING FEATURE FOR PINBALL GAMES

[75] Inventor: Lyman F. Sheats, Jr., Elk Grove, Ill.

[73] Assignee: Williams Electronics Games, Inc., Chicago, Ill.

[21] Appl. No.: 09/322,441

[22] Filed: May 28, 1999

[51] Int. Cl.[7] ..... A63F 7/30; A63F 9/24

[52] U.S. Cl. ..... 273/129 V; 273/129 R; 273/121 A; 273/119 R

[58] Field of Search ..... 273/118 R, 118 A, 273/119 R, 119 A, 121 R, 121 A, 129 R, 129 V, 129 W

[56] References Cited

U.S. PATENT DOCUMENTS

| | | | |
|---|---|---|---|
| 4,437,664 | 3/1984 | Wiczer et al. . | |
| 4,438,928 | 3/1984 | Wiczer | 273/121 R |
| 4,971,323 | 11/1990 | Gottlieb | 273/129 V |
| 4,971,324 | 11/1990 | Grabel et al. . | |
| 5,123,647 | 6/1992 | Lawlor et al. . | |
| 5,131,654 | 7/1992 | Gottlieb et al. . | |
| 5,284,342 | 2/1994 | Tanzer et al. . | |
| 5,297,793 | 3/1994 | DeMar et al. . | |

*Primary Examiner*—Raleigh W. Chiu
*Attorney, Agent, or Firm*—Jenkens & Gilchrist

[57] ABSTRACT

An automatic propelling feature for a pinball game having a playfield supporting a rolling ball and a plurality of targets thereon, comprises a propelling member, mounted to the playfield, for propelling the ball toward the target; a ball guide for guiding the ball to the propelling member; one or more sensors for detecting the ball along the ball guide; and processor circuitry, responsive to the sensors, for recording initial timing samples in a memory in response to the ball passing through the ball guide and being accurately propelled by the ball propelling member, operated by a player, toward one of the targets. In response to a predetermined number of the timing samples being recorded in the memory for at least one of the targets, the processor circuitry operates the propelling member based at least partially on the recorded timing samples and attempts to propel the ball toward the "qualifying" target in response to the ball passing through the ball guide. If a predetermined number of timing samples have been recorded in the memory for multiple ones of the targets such that there is more than one "qualifying" target toward which the processor can propel the ball, then the processor attempts to propel the ball toward the "qualifying" target that will yield a highest benefit to the player of the pinball game at that particular time in the game.

28 Claims, 41 Drawing Sheets

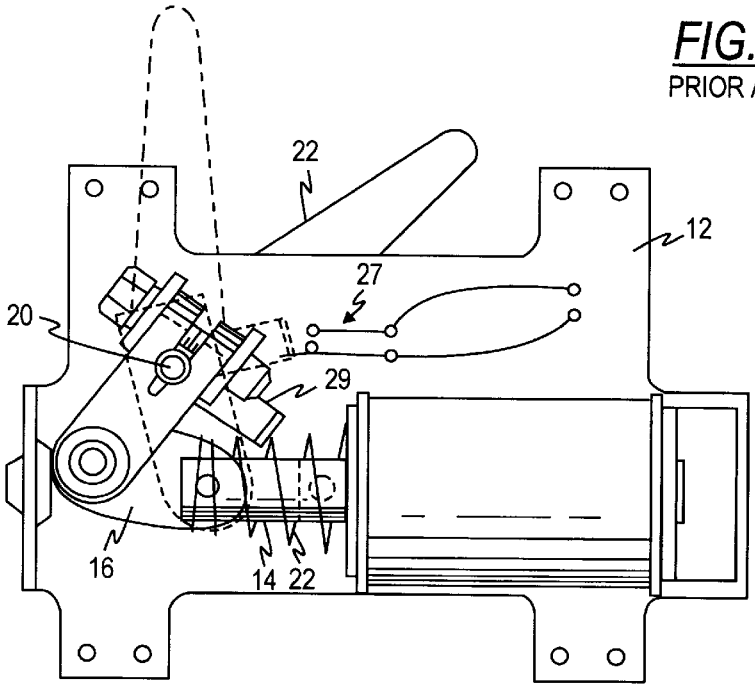
FIG. 1
PRIOR ART
FIG. 2
PRIOR ART
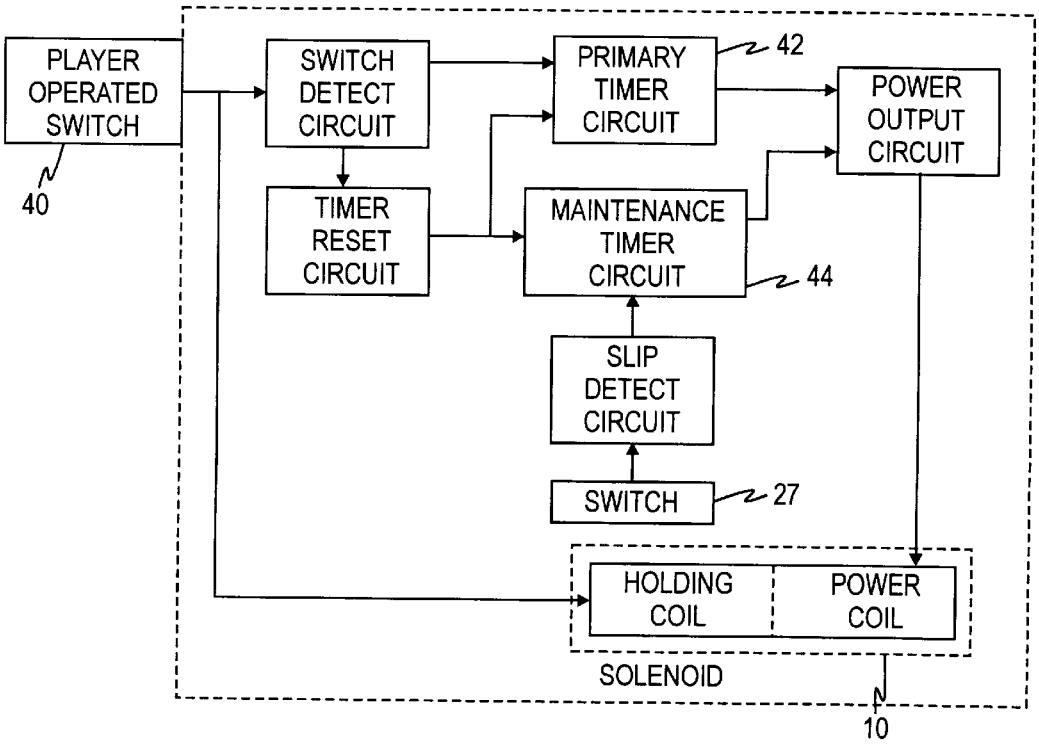

AUTOMATIC PROPELLING FEATURE FOR PINBALL GAMES

FIELD OF THE INVENTION

The present invention relates generally to an automatic propelling feature for a pinball game and, more particularly, relates to an automatic propelling feature in which the game processor initially learns to aim at targets on a pinball playfield in response to player-controlled shots made with a ball propelling member and in which the processor subsequently operates the ball propelling member to attempt to propel the ball toward one of the targets at which the processor has learned to aim.

BACKGROUND OF THE INVENTION

Pinball games generally include an inclined playfield housed within a game cabinet and supporting a rolling ball (i.e., pinball). A plurality of play features are arranged on the playfield. A game player uses a pair of mechanical flippers mounted at one end of the playfield to propel the rolling ball at the various play features on the playfield to score points and control the play of the game. It is typical of most pinball game designs to provide a varying number of sensors or switches on the playfield that allow the game processor to detect the presence of the ball and award the player with a score for activating a particular switch or sequence of switches. Activation of the scoring switches is achieved by propelling the ball toward a particular scoring area of the playfield with one of the player-operated flippers.

As is the case for virtually all pinball game designs, the score that is awarded for activating a particular switch may not be as "valuable" to the player as the score that is awarded for activating a different switch. Also, during the play of a game, the score that is awarded for activating a particular switch at a particular time during that game may not be as "valuable" to the player as the score that is awarded for activating the same switch at a different time during that game. It is often important for pinball players to understand which scoring switches are more "valuable" at different times and to attempt to direct the ball toward these higher scoring areas when possible. The ability of players to learn to direct the ball toward high scoring areas on the playfield with high frequency is what classifies pinball as a game of skill.

SUMMARY OF THE INVENTION

Since players possess varying levels of skill, one aspect of the present invention allows the game microprocessor to assist the player in directing the ball toward the "valuable" scoring areas or targets on the playfield. Specifically, the game microprocessor determines which scoring switches in the game are "valuable" to the player at any particular time and activates the flippers automatically to direct the ball toward these targets.

Another aspect of the present invention allows the game processor to initially learn to aim at the scoring areas on the playfield in response to player-controlled flipper shots.

In accordance with a preferred embodiment, an automatic propelling feature for a pinball game having a playfield supporting a rolling ball and a plurality of targets thereon, comprises a ball propelling member, mounted to the playfield, for propelling the ball toward the targets; a ball guide for guiding the ball to the flipper; one or more sensors for detecting the ball along the ball guide; and processor means, responsive to the sensors, for recording initial timing samples in a memory in response to the ball passing through the ball guide and being accurately propelled by the ball propelling member, operated by a player, toward one of the targets. In response to the timing samples being recorded in the memory for at least one of the targets, the processor means operates the ball propelling member based at least partially on the recorded timing samples and attempts to propel the ball toward the "qualifying" target in response to the ball passing through the ball guide. If a predetermined number of timing samples have been recorded in the memory for multiple ones of the targets such that there is more than one "qualifying" target toward which the processor can propel the ball, then the processor attempts to propel the ball toward the "qualifying" target that will yield the highest benefit to the player of the pinball game at that particular time in the game.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which:

FIG. 1 is a bottom plan view of a typical flipper assembly suitable for use with the present invention;

FIG. 2 is a block diagram of a typical circuit for operating a flipper solenoid;

Figure 3:
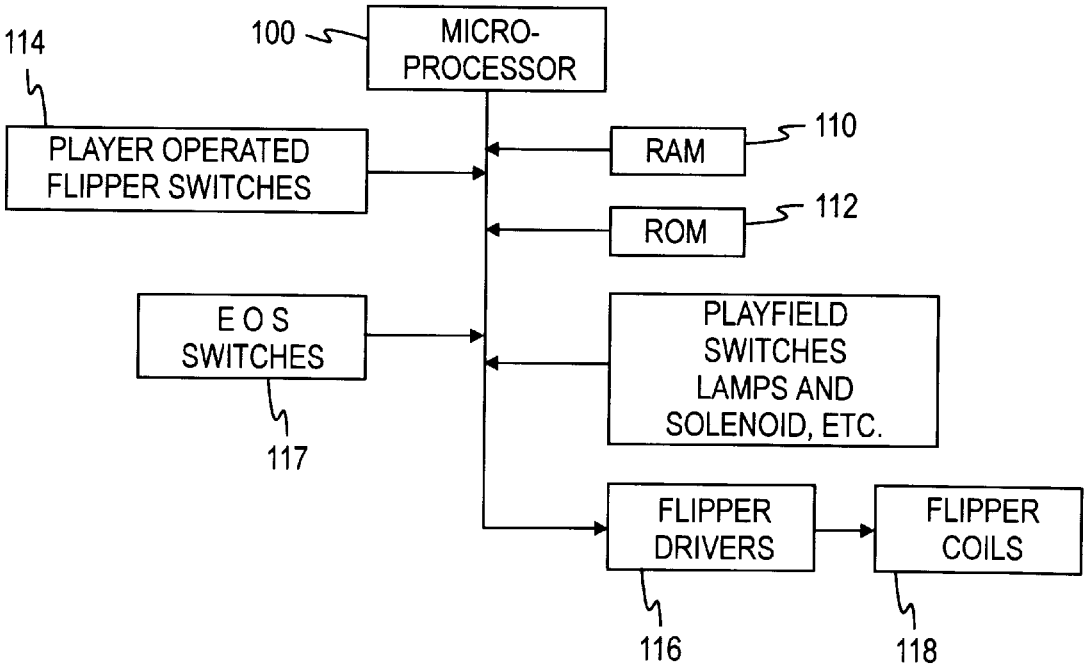
FIG. 3 is a block diagram of a game system suitable for use with the present invention.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF ILLUSTRATIVE EMBODIMENTS

Referring to FIG. 1, a typical flipper mechanism is illustrated in a bottom plan view. A solenoid 10 is secured to support 12 and includes a retractable plunger 14. Linkage 16, 18 is pivotally connected to plunger 14 such that the linear reciprocating motion of the plunger is translated into rotational motion of a shaft 20. A compression spring 22 is disposed coaxially over plunger 14 to return the plunger to its extended position upon deactivation of the solenoid 10. Shaft 20 extends above the playfield and has the flipper member 22 secured thereto for rotation as illustrated in phantom. An EOS switch 27 (which may be an optical, contact or similar switch) is fixed to support 12. Linkage 18 carries a member 29 extending therefrom such that EOS switch 27 can detect the fully actuated position of the flipper 22 shown in phantom. Should the flipper "slip" from the phantom position, this is signaled by EOS switch 27. The EOS switch 27 is also used for driver circuit timing.

Referring to FIG. 2, a block diagram of a typical flipper circuit is illustrated. In general, the FIG. 2 circuit actuates the solenoid 10 in response to the player operated flipper switch 40. When the switch is closed, a holding coil and a power coil are simultaneously energized providing maximum power to the solenoid. After a period of time determined by a timer circuit 42, or in response to a signal from the EOS switch 27, the power coil is deactivated leaving only the holding coil engaged. In the event that the EOS switch 27 detects slippage of the flipper, the power coil is briefly reenergized for a time period determined by the maintenance timer circuit 44.

It should be noted that the flipper assembly and circuitry of FIGS. 1 and 2 do not involve the game microprocessor. In contrast, the present invention employs different circuitry and permits the microprocessor, under the control of the game program, to operate one or more flippers. This is shown in block form in FIG. 3.

Referring to FIG. 3, game processor 100 is interconnected by a bus in the usual manner to RAM memory 110 and ROM memory 112. In addition, the bus permits communication between the processor and the various playfield switches, solenoids, lights and displays. In the case of the present invention, it also communicates with flipper switches 114 and flipper solenoid drivers 116 to operate the flipper solenoid coils 118.

As is known to those skilled in this art, the game processor typically controls the scoring and operation of the lights and displays as a function of the game software which is stored in the ROM memory 112. The game software responds to playfield switch closures causing the award of points, operation of lights and displays, actuation of playfield solenoids and similar devices. The RAM memory 110 is the processor's working memory in which current game data is stored and manipulated.

The processor also communicates with one or more player-operated flipper switches 114, traditionally located on the sides of the pinball game cabinet. The processor 100, upon receiving a signal that one or both flipper switches have been closed will normally activate the appropriate flipper solenoid drivers 116. The fully activated flipper position is then detected by EOS switch 117. Activation, however, is subject to the program contained in the memories 110 and 112. According to the present invention, it is also contemplated that the processor will operate the flipper drivers 116 without receiving a signal from the flipper switches 114.

Figure 4:
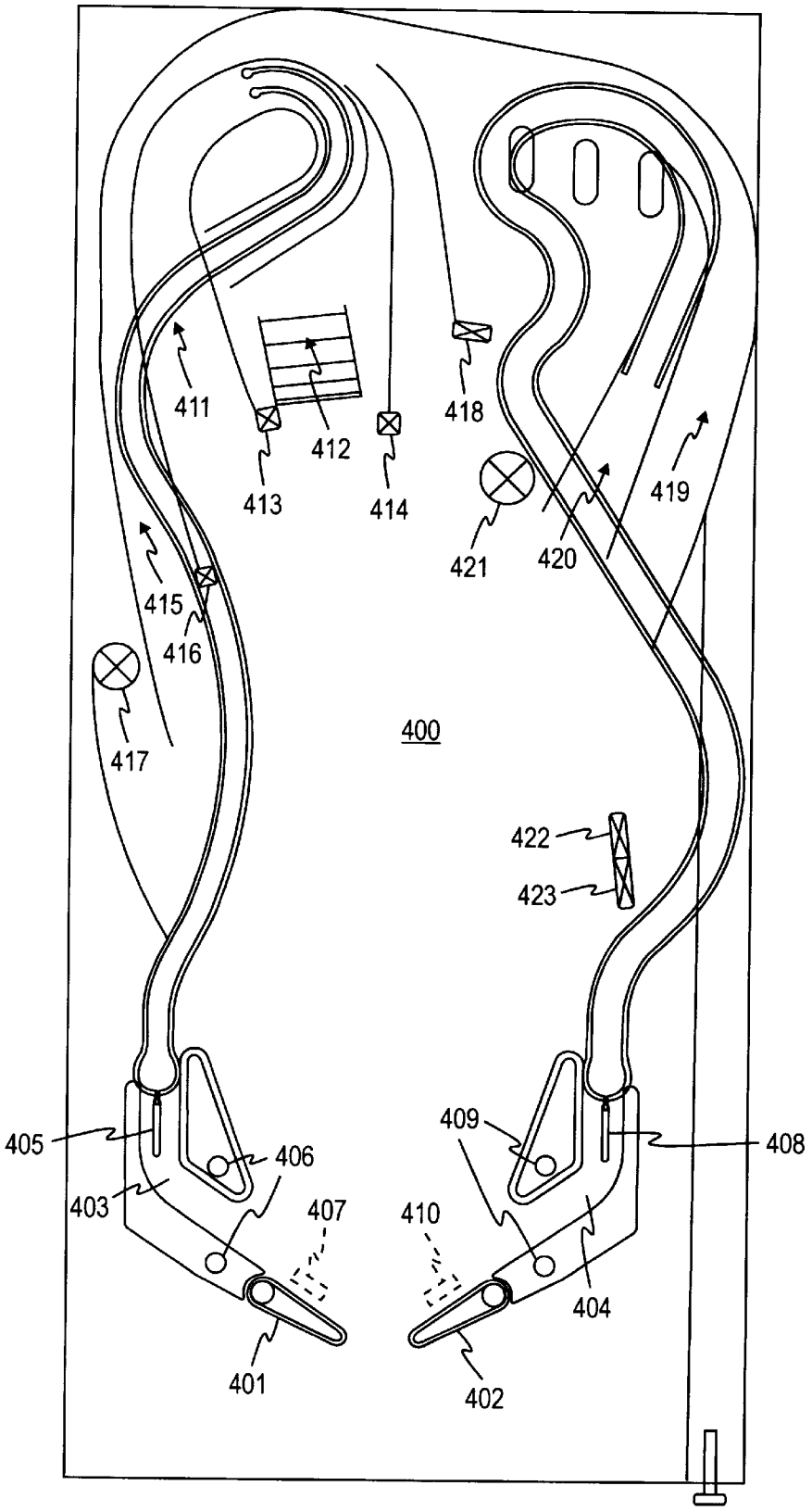
FIG. 4 is a plan view of a pinball playfield employed by the present invention.

FIG. 4 shows the invention as used in a typical pinball game. At the bottom part of a playfield 400 are a pair of flippers 401 and 402. The flippers 401 and 402 are normally player-operated and used to direct the ball toward the various scoring areas or targets 411–423 on the playfield 400. The left flipper 401 is typically used to direct the ball toward the scoring areas 418–423, and the right flipper 402 is typically used to direct the ball toward the scoring areas 411–417. Since the particular structure of the scoring areas is not relevant to the present invention, some of the scoring areas are only illustrated as rectangles or circles encompassing X's.

If the flippers 401 and 402 are to be operated automatically by the game processor such that the ball is directed toward a specific scoring area consistently, the processor, at a minimum, requires two pieces of information. The first is the ball velocity through ball lanes 403 and 404. The second is the amount of time to wait before automatically activating the flippers 401 and 402 once the velocity of the ball has been determined.

To determine ball velocity toward the left and right flippers 401 and 402, a trio of sensors is used for each flipper lane. For the left flipper 401, the sensor 405, a rollover micro-switch, serves as a starting point for the ball to be delivered to the left flipper 401 via the left flipper ball lane 403. The sensors 406 (an optical switch) and 407 (a proximity switch) are used to determine ball velocity as the ball travels along the left flipper ball lane 403 toward the left flipper 401. The left flipper optical switch 406 includes an LED transmitter and a photodetector mounted slightly above the surface of the playfield 400 and on opposite sides of the ball lane 403. The left flipper optical switch 406 detects the presence of the ball when the ball breaks the path of the optical beam directed from the LED toward the photodetector. The left flipper proximity switch 407, mounted underneath the playfield 400 and near the left flipper 401, detects the presence of the ball when the ball travels on the surface of the playfield 400 above the switch 407. The velocity of the ball along the left flipper ball lane 403 toward the left flipper 401 is measured as a function of time from when the ball leaves the path of the left flipper optical beam to the time the ball is detected by the left flipper proximity sensor 407. This time will be shorter for a ball that is traveling at a high rate of speed and longer for a ball that is traveling at a low rate of speed. Similarly, the trio of sensors used for determining ball velocity through the right flipper ball lane 404 toward the right flipper 402 are the sensors 408 (a rollover micro-switch), 409 (an optical switch), and 410 (a proximity switch). Other types of sensors may be used so long as they are capable of detecting the presence of the ball.

Once the velocity of the ball is known, it is necessary to determine the amount of time to wait before activating the flipper 401, 402 such that the ball is directed accurately toward the intended target. The velocity of the ball is first known when the proximity sensor 407, 410 detects the presence of the ball after the ball has passed through the optical switch 406, 409. Some amount of time must then elapse before the flipper 401, 402 is activated such that the ball is directed accurately toward the intended target. In the preferred embodiment, the intended targets for the left flipper 401 are the targets 421, 420, and 419, while the intended targets for the right flipper 402 are the targets 415, 411, and 412. It is clear from FIG. 4 that the amount of time to wait before activating the flipper 401, 402 will vary based on the intended target. The farther away the intended target is from the center line of the playfield 400, the longer the amount of time will be to wait before activating the flipper 401, 402.

Determining the amount of time to wait before automatically activating the flipper 401, 402 once the current velocity of the ball is known can be handled in a variety of ways. One way, described in U.S. Pat. No. 5,297,793 to DeMar, is a "drunk walk" algorithm where the processor uses predetermined initial delay times that are typical for most games. In the DeMar patent, the processor selects delay times from an array until the automatic flipper hits a known target. If the target that was hit was not the intended target, the processor adjusts the delay time appropriately, based on the target that was hit, until the delay time for subsequent processor-controlled flips is accurate for the intended target.

This method works well for the application described in the DeMar patent, but does not work well for the playfield diagrammed in FIG. 4. Consider, for example, the intended target 420 (the right ramp). Using the "drunk walk" algorithm, it is possible that an initial delay time typical for this target could be selected such that the ball does not hit any of the targets at 418–423. The scenarios for this case include (1) the ball hitting a rubber barrier between targets 420 and 421 (delay time too short) and (2) the ball hitting a rubber barrier between targets 420 and 419 (delay time too long). If the ball should hit these barriers as a result of an automatic flip or any other target that is not known to the feedback system, there would be no way for the system to decide whether the shot was early or late.

Because of the lack of feedback sensors in close proximity to some of the intended targets on the playfield in FIG. 4, it is preferable that the initial flip delay for an intended target be more precise. In the present invention, the initial flip delay for an intended target is "learned" from the player when the player hits the intended target. The flip delay time is measured as a function of time from when the ball is detected by the proximity sensor 407, 410 to the time the flipper 401, 402 is activated by the player.

When the game is operated for the first time, there is no ball velocity or flipper delay information for any of the intended targets. In order for the automatic flip feature to be activated for a particular target, the present invention merely requires that a predetermined number of samples (preferably two) be recorded for that target. With respect to the three targets 419, 420, and 421, a sample is recorded when the ball rolls over the rollover switch 405, rolls down the ball lane 403, interrupts the optical beam created by the optical switch 406, passes over the proximity sensor 407, and is accurately flipped by the player at one of the targets using the left flipper 401. Likewise, with respect to the three targets 411, 412, and 415, a sample is recorded when the ball rolls over the rollover switch 408, rolls down the ball lane 404, interrupts the optical beam created by the optical switch 409, passes over the proximity sensor 410, and is accurately flipped by the player at one of the three targets using the right flipper 402. The sample is recorded in the database associated with the target hit by the ball.

When the predetermined number of samples are recorded in the database associated with a particular target, the automatic flip feature can be activated for that target. Activation of the automatic flip feature is represented on the playfield by a light that is "on" when the feature is available and "off" when the feature is not available. When the feature is available and the ball rolls down the appropriate ball lane 403, 404, the processor takes control of the flipper 401, 402 associated with the ball lane 403, 404 and attempts a shot at a target. The target that is attempted is based on (1) the system having timing information for the target, and (2) the system knowing which of the targets in the set of targets for which there is timing information will be most beneficial to the player in terms of the score that will be awarded should the target be hit. If the attempted shot is made, a sample is generally recorded in the database associated with the intended target. If the shot is missed, and the processor has obtained information as to which side of the intended target the miss occurred, the miss is generally recorded in the database associated with the intended target. A miss falls into one of two categories: an early miss or a late miss. An early miss indicates to the system that the flip delay for an intended target may be too short for the target to be hit. A late miss indicates to the system that the flip delay for an intended target may be too long for the target to be hit. Based on the number of early and late misses recorded for a particular target's database, the flip delay may be modified appropriately. For early misses, the flip delay may be increased, such that subsequent automatic flips will be less "early". For late misses, the flip delay may be decreased, such that subsequent automatic flips will be less "late".

An advantageous feature of the present invention is that the processor can quickly learn to aim at multiple targets on a pinball playfield in response to player-controlled flipper shots. In contrast, in U.S. Pat. No. 5,297,793 to DeMar, the processor could learn to aim at a single target in response to only processor-controlled flipper shots. By learning from the player, the processor of the present invention can potentially learn to aim more quickly and accurately at multiple targets than if the processor learned from prior processor-controlled shots, particularly if the processor-controlled shots were initiated by estimating the timing for an intended target. This is especially true under variable conditions associated with installation and operation of the pinball game in an arcade or the like. Subtle differences in the angle of the playfield can affect the velocity of the ball which, in turn, can affect the required timing on actuating the flippers to hit the targets. Varying line voltages and degradation of the flipper solenoid strength can also affect the operation of the flippers that, in turn, can affect the required timing on actuating the flippers to hit the targets. Additionally, the physical design of the playfield may be such that processor-controlled shots cannot consistently detect whether a missed attempt was "early" or "late", such that the timing for the shot can be corrected appropriately. A player can likely adjust more quickly to the different installation and operating conditions and, therefore, more readily teach the processor how to aim at the targets.

The preferred embodiment described below consists of a five parameter system. Parameter one is the average amount of time (in milliseconds) it takes for the ball to travel from the trailing edge of the flipper lane optical beam 406, 409 to the leading edge of the flipper proximity sensor 407, 410. This time represents the velocity of the ball. Parameter two is the average amount of time (in milliseconds) to wait (delay) before flipping the flipper 401, 402 after the ball has reached the leading edge of the flipper proximity sensor 407, 410. Both the velocity and the flip delay for the intended targets on the playfield 400 are recorded when either the player or the automatic flipper hits the intended targets. Once the system has collected enough velocity and flip delay samples to compute an average, the third parameter, the flip delay scalar, is calculated. The flip delay scalar tells the system how much time to add to or subtract from the average flip delay when it sees a velocity that is not exactly equal to the average velocity. This parameter lets the system increase the flip delay for slow velocities and decrease the flip delay for fast velocities. Parameter four is the fast flip delay scalar. This value specifies how much time the system adds to or subtracts from the flip delay scalar for every four milliseconds a velocity falls below the average velocity. Parameter five is the slow flip delay scalar. This value specifies how much the system adds to or subtracts from the flip delay scalar for every four milliseconds a velocity rises above the average velocity. The fourth and fifth parameters provide a means for the system to adjust the scalar, although indirectly, since the flip delay scalar is never modified after it is computed for new velocity and flip delay averages. The main advantage to maintaining the fourth and fifth parameters independently of the flip delay scalar is that based on the values of the parameters, the results of computing flip delay times across the entire range of possible velocities becomes non-linear. When the automatic flipper is activated, the system monitors the various switches on the playfield to determine whether the shot was "early", "late", or "correct", and adjusts the parameters accordingly. Hits and misses for ball velocities that are near the average are used to adjust the flip delay (parameter two). Hits and misses for ball velocities that are far from the average on the fast side are used to adjust the fast flip delay scalar (parameter four). Hits and misses for ball velocities that are far from the average on the slow side are used to adjust the slow flip delay scalar (parameter five).

Once the system has accumulated eight velocity and flip delay samples for an intended shot (four computations of averages in sets of two), flip delay samples are no longer averaged into the existing average for the database. With eight or more samples, the flip delay is adjusted on player shots by determining how far off the calculated flip delay (using the same parameters) is from the flip delay seen from the player shot. The "early", "correct", and "late" numbers in the database are then modified based on the difference of the calculated flip delay and the player's correct flip delay. The velocity is still logged, requiring additional samples to compute each new average. When a new average velocity is now calculated, the flip delay is altered in proportion to the new average velocity.

Figure 5:
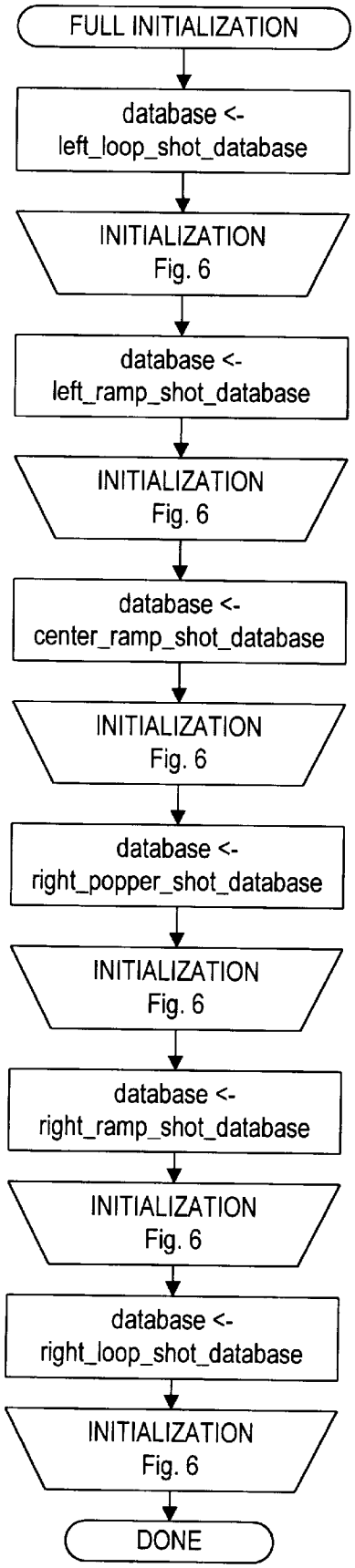
FIGS. 5, 6, 7, 8A–G, 9A–G, 10, 11, 12, 13, 14, 15, 16, 17, 18A–D, 19, 20, 21, 22, 23, 24, 25, 26, 27, 28, 29, 30, 31, 32, 33, 34, 35, 36, and 37 are flow diagrams useful in explaining operation of the invention.

FIG. 5 et seq. illustrate the software logic of the preferred embodiment of the present invention. FIG. 5, Full Initialization, illustrates the routine that is called the first time the game operates or whenever the battery back-up fails or the game is reset manually. This routine simply initializes all of the databases that hold auto-flip data for the intended targets listed in FIG. 4. The targets are the Left Loop Shot (FIG. 4, 415), the Left Ramp Shot (FIG. 4, 411), the Center Ramp Shot (FIG. 4, 412), the Right Popper Shot (FIG. 4, 421), the Right Ramp Shot (FIG. 4, 420), and the Right Loop Shot (FIG. 4, 419).

Figure 6:
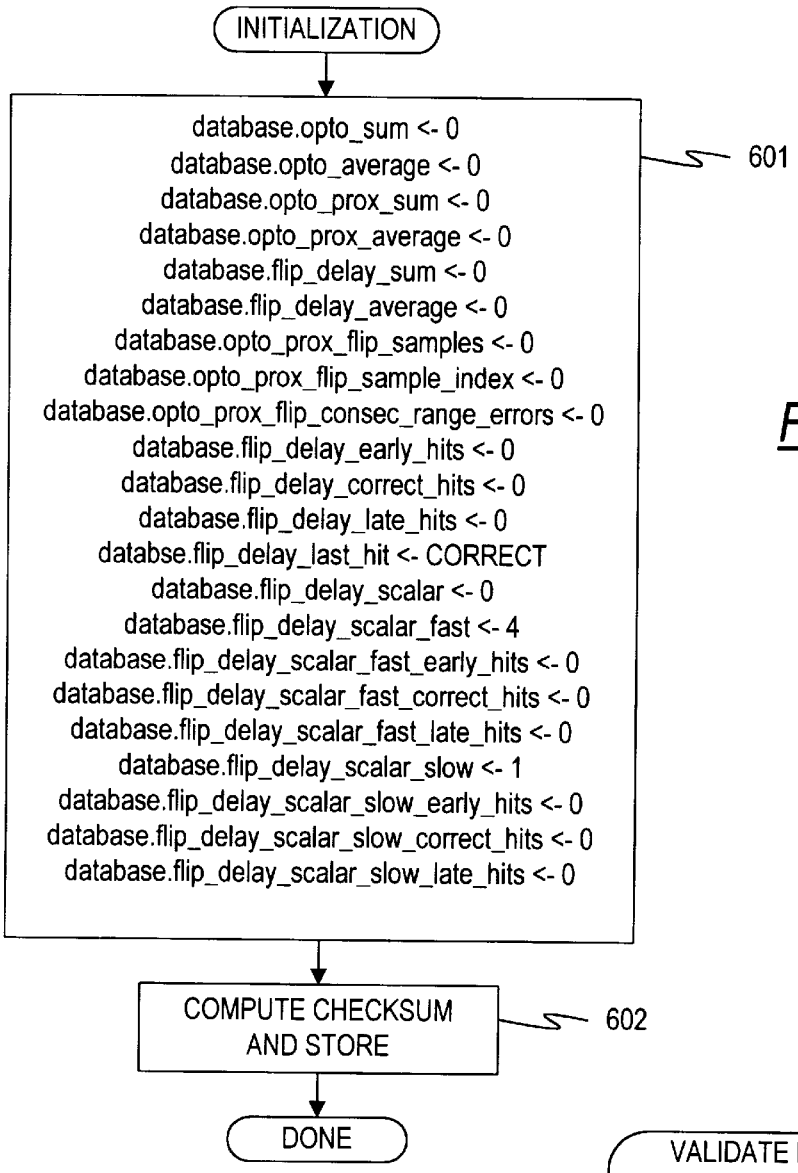
Figure 7:
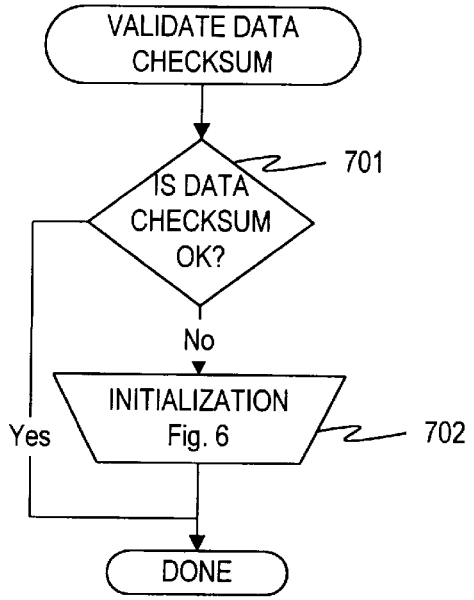

FIG. 6 diagrams the initialization process for a single shot database. This is called from the Full Initialization routine in FIG. 5 and when an invalid checksum for the database is detected (FIG. 7). At 601, each member of the shot database is cleared, and initial values are set for 'flip_delay_last_hit' (CORRECT), 'flip_delay_scalar_fast' (4), and 'flip_delay_scalar_slow' (2). A checksum for the database region in memory is computed and stored at 602. The routine ends.

FIG. 7 diagrams the routine used to validate the checksum for a shot database. A check is made at 701 to see if the computed checksum for the data in the database matches the checksum stored in the region. If the checksums match, the routine ends. If the checksums do not match, the database is initialized (FIG. 6) at 702, and the routine ends.

Figure 8A:
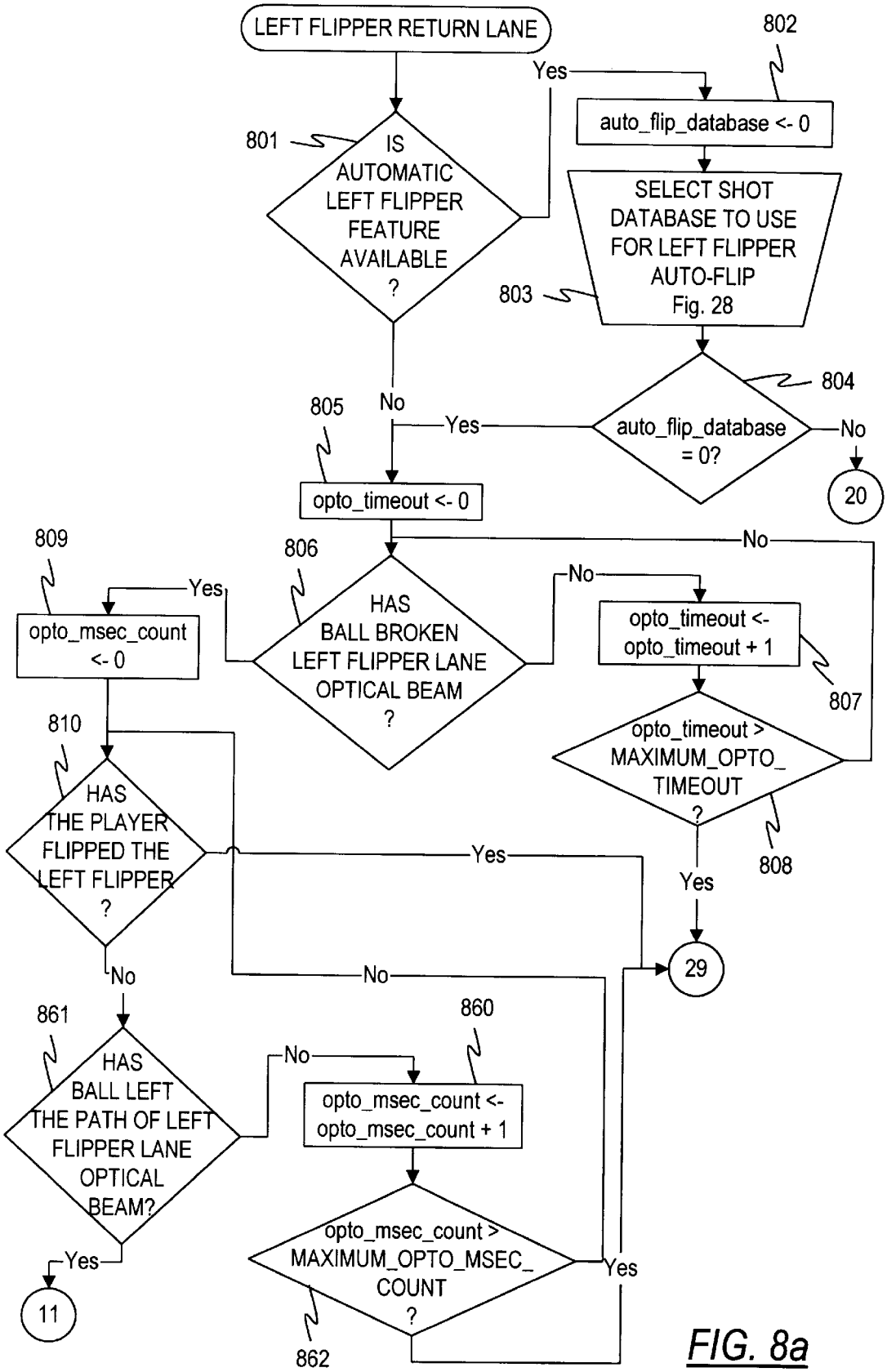
Figure 8B:
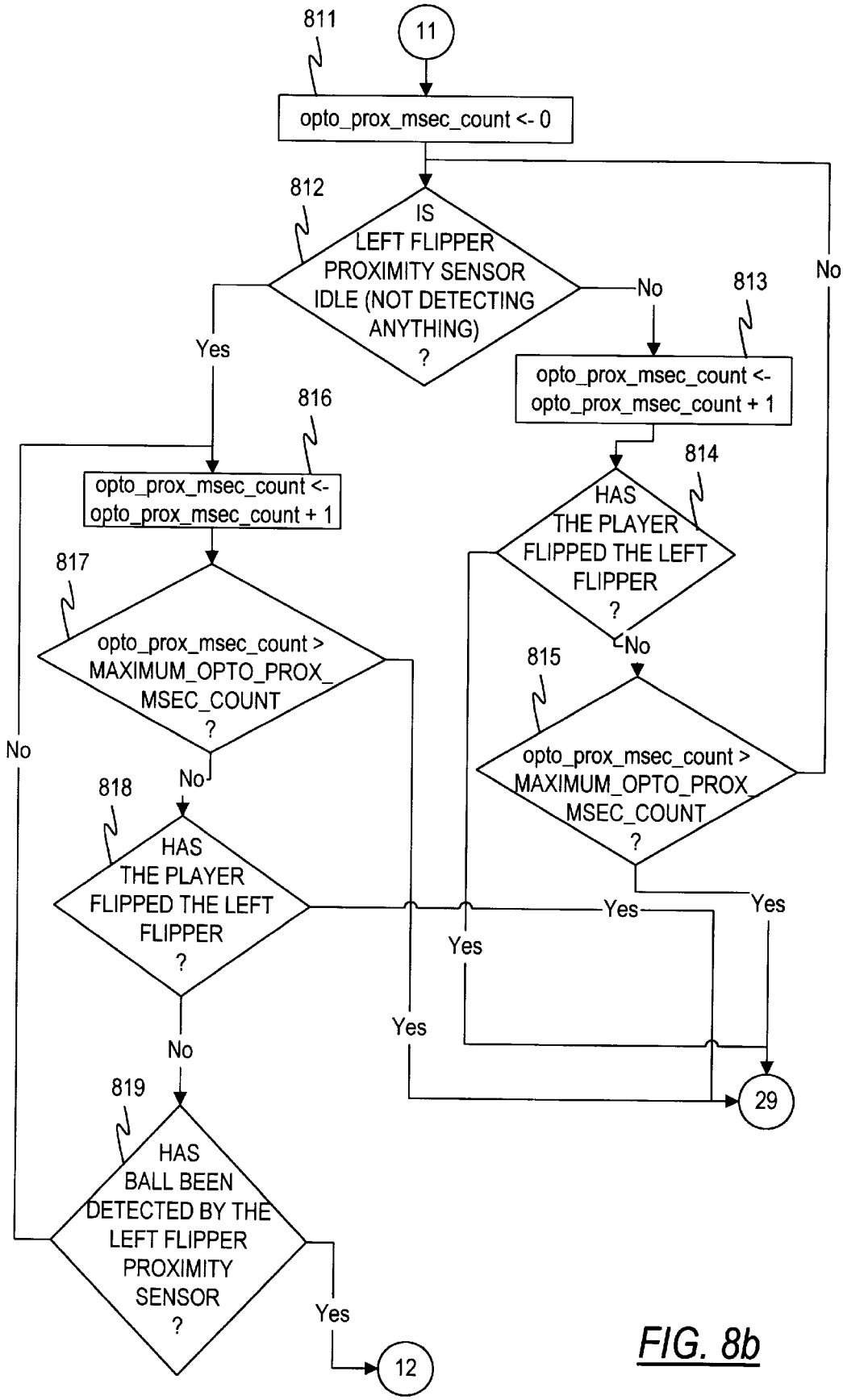
Figure 8C:
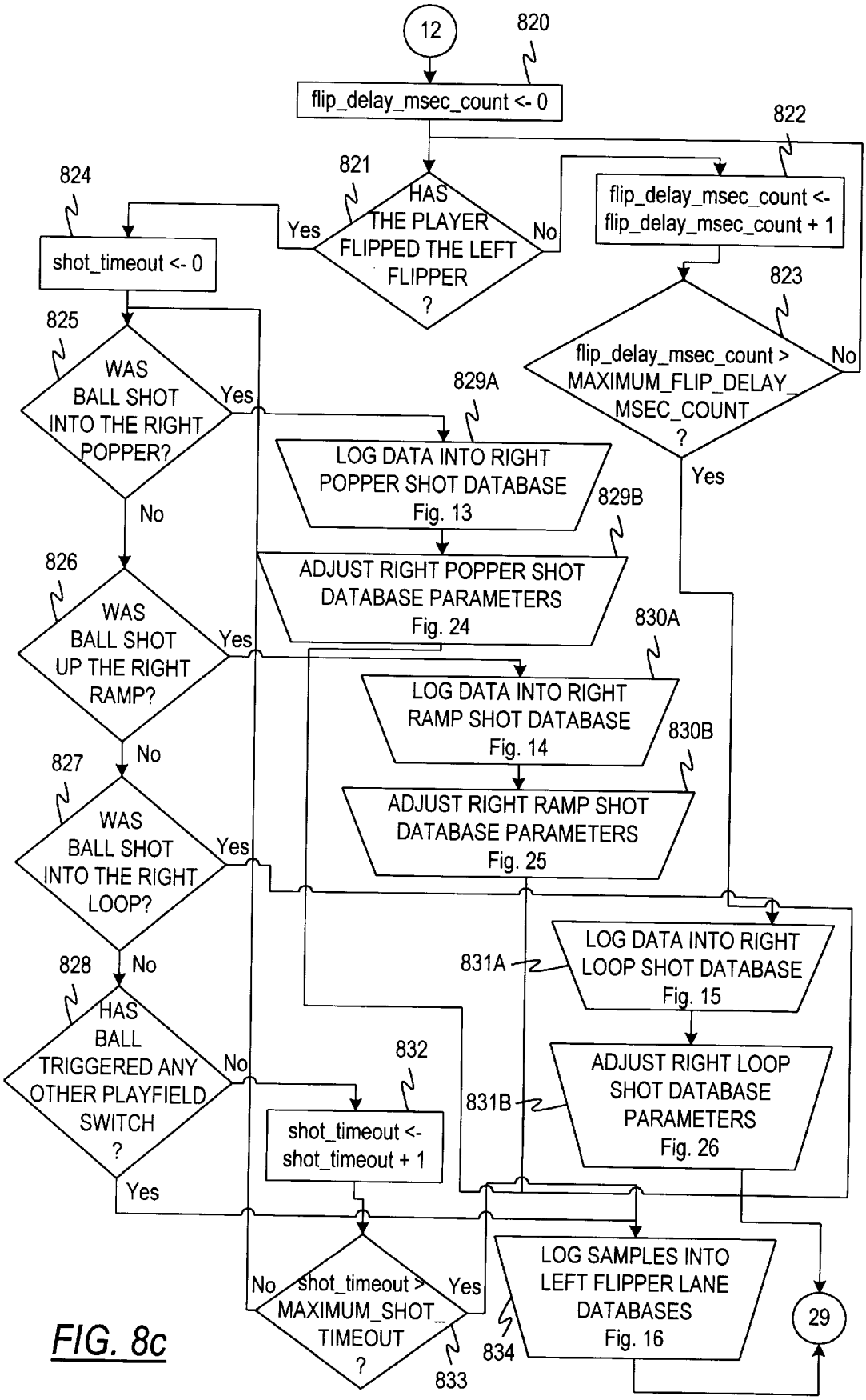

FIGS. 8A–8G shows the program logic for accumulating left flipper auto-flip data from the player and the program logic for a left flipper automatic flip. The figures are divided into two groups: FIGS. 8A–8C deal with a player controlled flip, while FIGS. 8D–8G deal with an automatic flip. Both flows of logic start with the detection of the ball at the left flipper lane micro-switch (FIG. 4, 405).

In FIG. 8A, a check at 801 is made to see if the automatic flipper feature is available for the left flipper. Typically, the feature will be made available when the player completes a particular scoring sequence in the game, and made unavailable when the automatic flip for the left flipper occurs. The manner in which the feature is enabled and disabled depends upon the desires of the game designer. If the feature is available, the auto-flip database variable at 802 is set to zero, and the routine at 803 is called to select a shot database for the left flipper auto-flip. If the routine returns a valid database ('auto_flip_database'≠0 at 804), flow is directed to the auto-flip logic in FIG. 8D, 20.

If the automatic flipper feature is not available, or if the routine called to select a left flipper auto-flip database fails to return a valid database, the system will follow the logic flow of FIGS. 8A–8C and attempt to learn a shot for the left flipper (FIG. 4, 419, 420, or 421) from the player instead. In FIG. 8A, 805, a timeout for the left flipper lane optical switch is initialized to zero. A check is then made at 806 to see if the ball has broken the path of the left flipper lane optical switch 406 (FIG. 4). If not, the timeout for the optical switch is increased at 807 and checked against a maximum ('MAXIMUM_OPTO_TIMEOUT', about 1.5 seconds) at 808. If this maximum timeout is exceeded before the ball breaks the path of the left flipper lane optical switch, it is assumed that the ball never made it to the switch or that the optical switch is faulty. In either case, the routine ends.

Once the ball breaks the path of the left flipper lane optical switch 406, the variable 'opto_msec_count' is initialized to zero at 809. This variable is used to count the number of milliseconds that the ball blocks the beam of the optical switch. A check is made at 810 to see if the player has already flipped the left flipper. If so, the routine ends. If not, the variable 'opto_msec_count' is increased at 860 to a maximum ('MAXIMUM_OPTO_MSEC_COUNT', about 250 milliseconds) after a check is made at 861 to see if the ball has left the path of the left flipper lane optical switch. If this maximum is exceeded at 862, it is assumed that the optical switch is faulty and the routine ends.

Referring to FIG. 8B, once the ball has left the path of the left flipper lane optical beam, the variable 'opto_prox_msec_count' is initialized to zero at 811. This variable is used to count the number of milliseconds it takes for the ball to travel from the trailing edge of the left flipper lane optical switch 406 (FIG. 4) to the leading edge of the left flipper proximity switch 407 (FIG. 4). A check is made at 812 to ensure that the proximity switch is idle, i.e., not detecting the ball. It is important to first check that the switch is idle, since the typical failure mode of the proximity sensor is to be stuck in the active (detecting the ball) position. If a check was made that the proximity switch was closed at this point, and the switch was stuck active, the system would erroneously determine the value of 'opto_prox_msec_count' to be zero. This is impossible since, in FIG. 4, the ball cannot possibly be at positions 406 and 407 at the same time.

If the left flipper proximity switch never becomes idle, the logic at 813, 814, and 815 is executed repeatedly until the player flips the left flipper, or when the value of 'opto_prox_msec_count', incremented at 813, exceeds its maximum value ('MAXIMUM_OPTO_PROX_MSEC_COUNT', about 350 milliseconds). If either of these two conditions is met (the latter of the two indicating that there may be a problem with the proximity switch 407), the routine ends.

Once the left flipper proximity switch 407 becomes idle, the sequence at 816, 817, 818, and 819 executes. The variable 'opto_prox_msec_count' is incremented at 816, and, similar to earlier logic, the routine terminates at 817 if the value of 'opto_prox_msec_count' exceeds its maximum value, or at 818 if the player has flipped the left flipper.

Once the proximity switch has detected the presence of the ball in FIG. 8C at 12, 'flip_delay_msec_count' at 820 is initialized to zero. This variable is used to count the number of milliseconds it takes for the player to flip the flipper after the proximity switch has detected the presence of the ball. The loop at 821, 822, and 823 continually checks to see if the player has flipped the left flipper, and increments 'flip_delay_msec_count' if the player has not. If 'flip_delay_msec_count' exceeds its maximum ('MAXIMUM_FLIP_DELAY_MSEC_COUNT', about 250 milliseconds), the routine ends.

Once the player has flipped the left flipper, the variable 'shot_timeout' is initialized to zero at 824. This variable is used to provide a window of time in which the system is allowed to detect which of the shots for the left flipper (FIG. 4, 419, 420, and 421) the ball has registered. Checks are made at 825, 826, and 827 to see which of the shots were hit. If one of the shots was hit, the data accumulated for the left flipper by this routine is logged into the appropriate database at 829A, 829B, 830A, 830B, 831A, 831B, and the routine ends. If some other playfield switch was registered at 828, or if the window of time for detecting a shot expires at 832 and 833 (MAXIMUM_SHOT_TIMEOUT, about 1.75 seconds), it is assumed that no shots were hit. In this case, the velocity samples accumulated by the routine are logged at 834 (if necessary), and the routine ends.

The automatic left flipper logic of FIGS. 8D–8G is similar to that of the player flipper logic of FIGS. 8A–8C. Only the differences between the two flows of logic will be pointed out.

Referring to FIGS. 8D–8G, the first major difference to note is that it is not desirable to perform the checks to see if the player has flipped the left flipper. The auto-flip logic disables the left flipper and takes away player flipper control, so these checks have been removed.

Figure 8D:
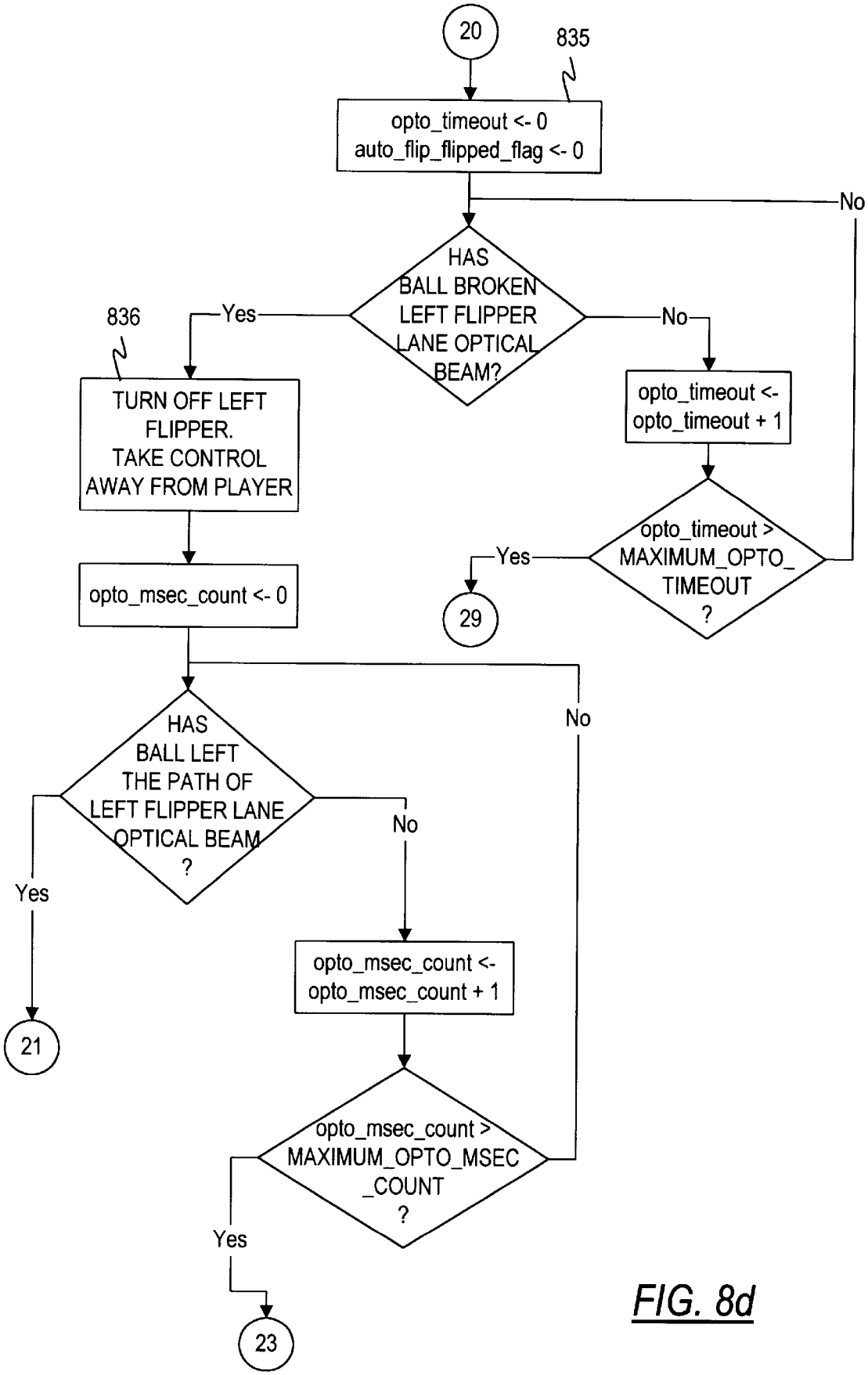
Figure 8E:
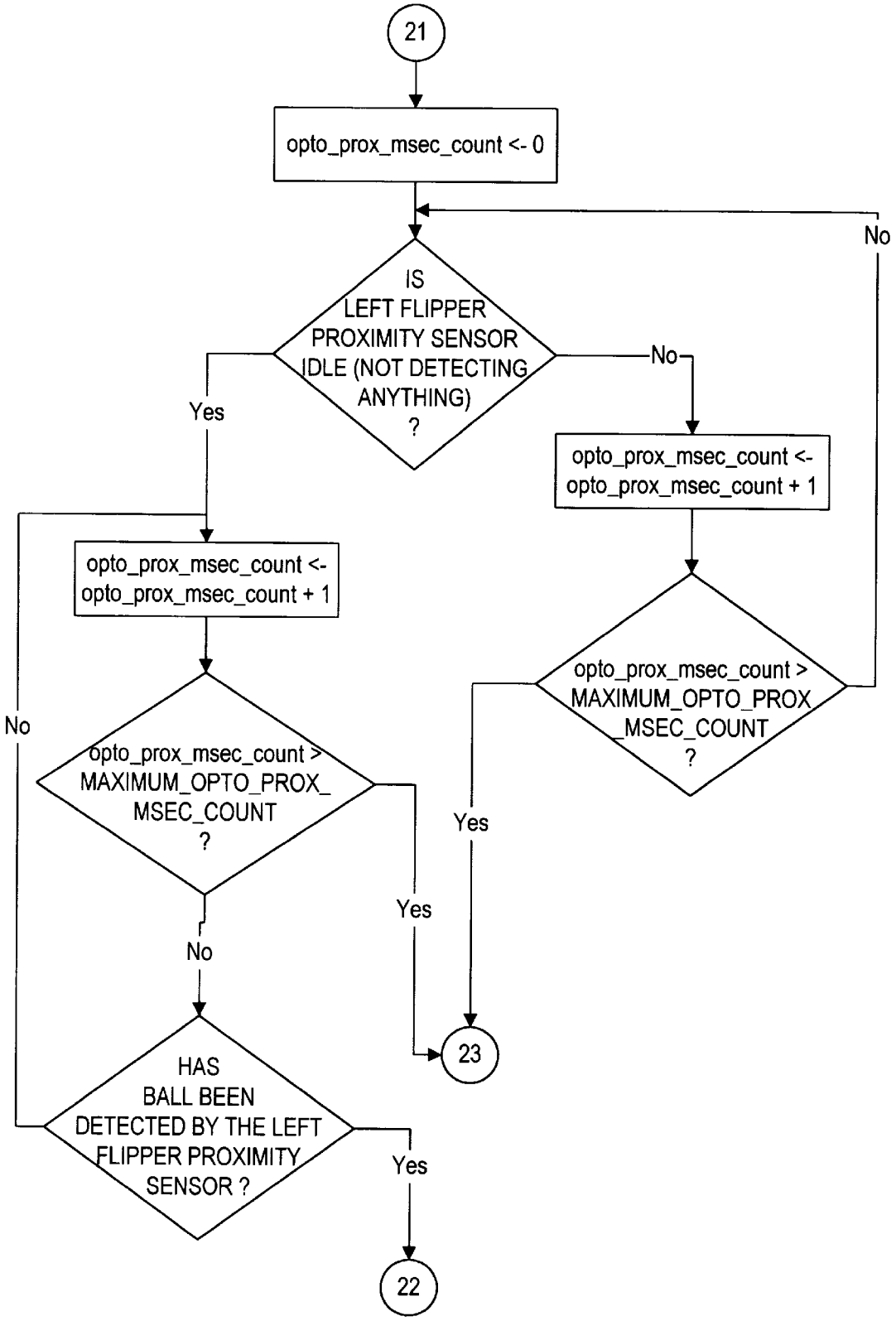

Referring to FIG. 8D, an additional variable, 'auto_flip_flipped_flag' at 835 is initialized to zero. This variable lets later left flipper auto-flip logic know whether or not the automatic flipper was activated. If this variable is zero when it is checked, then the auto-flip logic has not activated the automatic flipper.

Another difference in the logic is at 836, immediately after the ball has first broken the path of the left flipper lane optical beam 406. As soon as the ball has broken the path of the beam, the left flipper is turned off, and all player requests to operate the flipper from this point forward are ignored. It is important to turn off the flipper and take away player control on detecting the ball at the leading edge of the optical switch, as it takes some amount of time for the flipper mechanism to return to its rest position if it is raised when disabled. If flipper control is taken away at a later time, the ball may reach the flipper while the flipper is still raised, which would always result in a missed shot attempt. As soon as the left flipper has been disabled in this fashion, all of the error condition branches that occur must branch to a point that re-enables the left flipper and must return flipper control to the player. These branches occur in FIGS. 8D and 8E at 23.

Figure 8F:
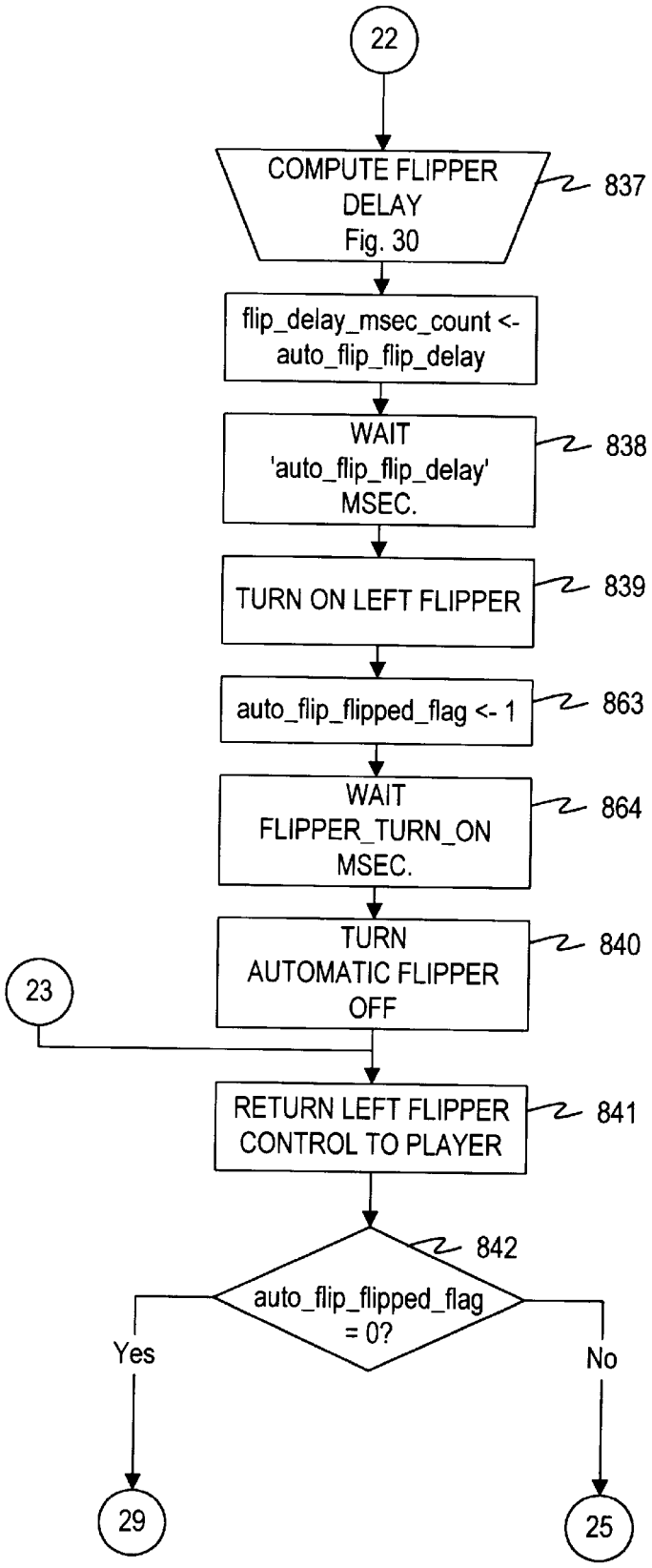
Figure 8G:
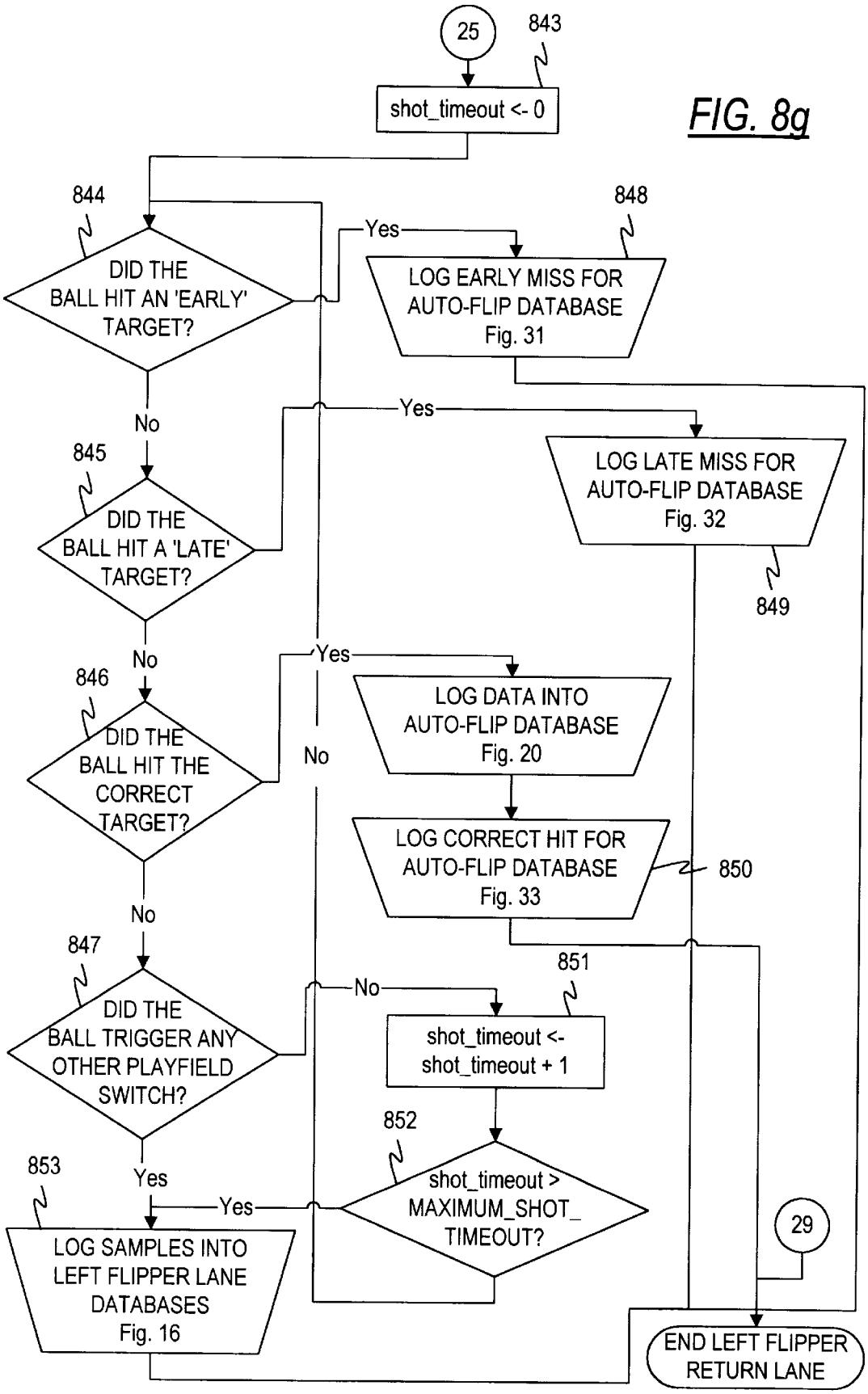

FIG. 8F shows the auto-flip logic immediately after the left flipper proximity sensor 407 has detected the presence of the ball. At 837, the amount of time to wait (in milliseconds) before flipping the automatic left flipper is calculated. The computer waits the calculated number of milliseconds at 838 and then turns on the left flipper at 839. After the flipper is turned on, the variable 'auto_flip_flipped_flag' is set to 1 at 863 to indicate that the computer has flipped the left flipper. The computer must then wait ('FLIPPER_TURN_ON' milliseconds, about 80) at 864 to allow the flipper solenoid to become energized before turning off the left flipper at 840. Left flipper control is returned to the player at 841. At 842, a check of 'auto_flip_flipped_flag' is made to determine whether or not the computer activated the automatic left flipper. If the computer did not activate the left flipper, the routine ends. If the computer activated the left flipper, the variable 'shot_timeout' is initialized to zero in FIG. 8G at 843. This variable is used to provide a window of time in which the system is allowed to detect which shots were hit for 'auto_flip_database'. Each check at 844, 845, and 846 is made with respect to the shot that the automatic flipper was attempting to hit. If the shot selected in FIG. 8A at 803 was the Right Popper Shot (FIG. 4, 421, 'auto_flip_database'=right_popper_shot_database), then the "early" target is at 418, the "correct" target is at 421, and the "late" target is at 420. If the shot selected in FIG. 8A at 803 was the Right Ramp Shot (FIG. 4, 420, 'auto_flip_database'=right_ramp_shot_database), then the "early" target is at 421, the "correct" target is at 420, and the "late" target is at 419. If the shot selected in FIG. 8A at 803 was the Right Loop Shot (FIG. 4, 419, 'auto_flip_database'=right_loop_shot_database), then the "early" target is at 420, the "correct" target is at 419, and the "late" targets are at 422 and 423.

If it is determined that the ball has hit either an "early", a "late", or a "correct" target, the appropriate action for the target that was hit is taken at 848, 849, or 850. If some other playfield switch was registered at 847, or if the window of time for detecting a target expires at 851 and 852 (MAXIMUM_SHOT_TIMEOUT, about 1.75 seconds), it is assumed that no useful targets were hit. In this case, the velocity data samples accumulated by the routine are logged at 853 (if necessary), and the routine ends.

Figure 9A:
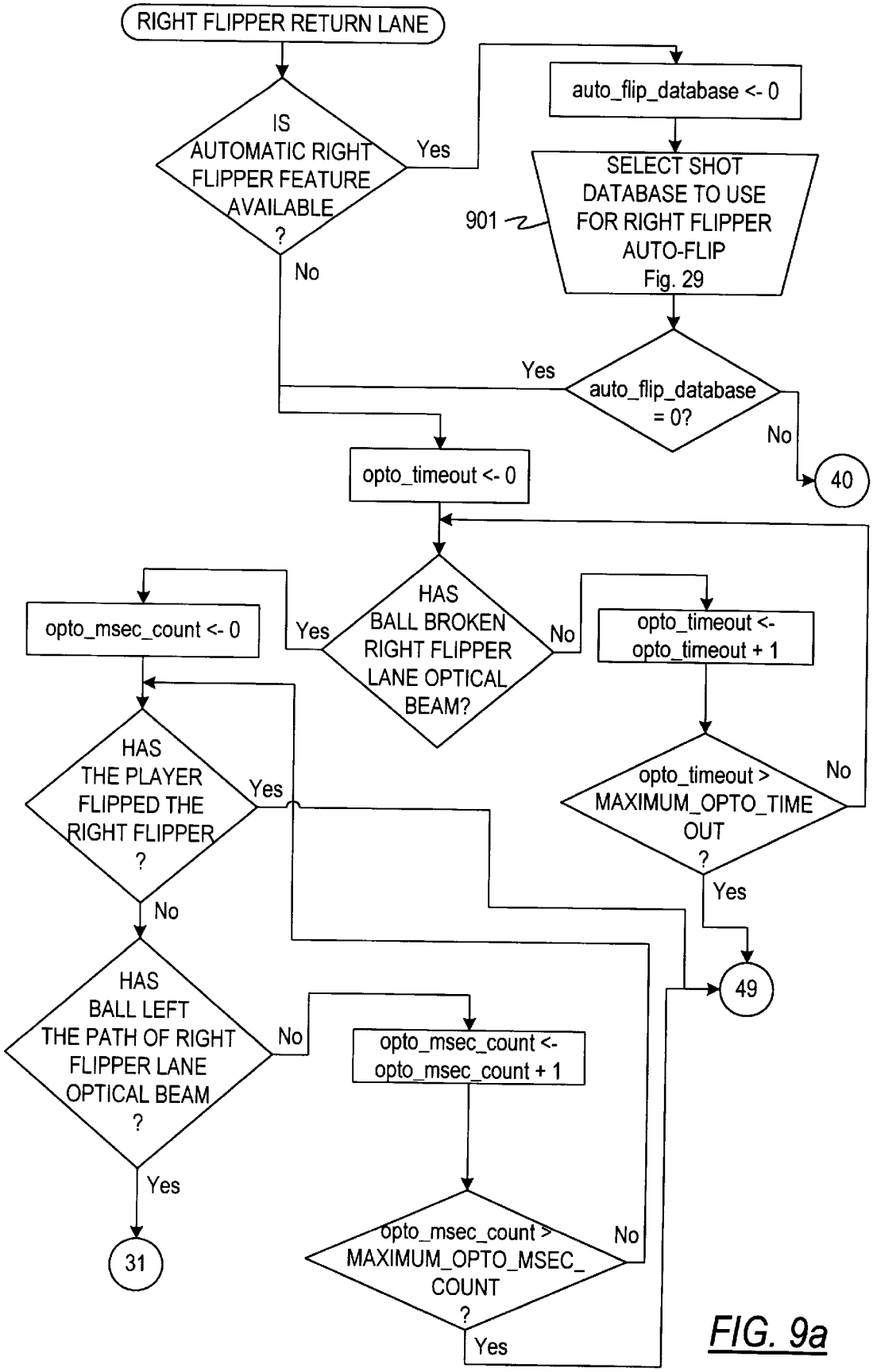
Figure 9B:
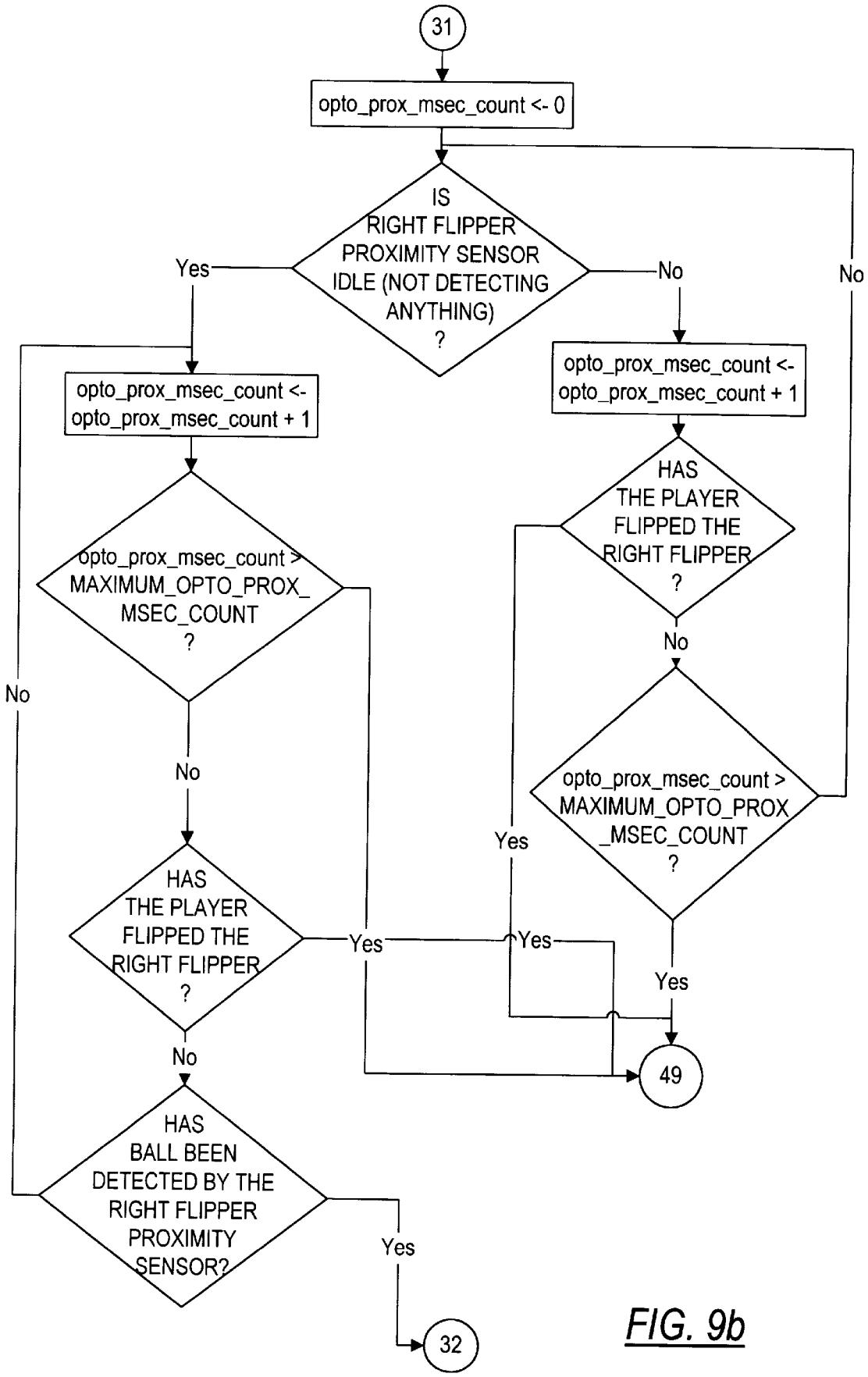
Figure 9C:
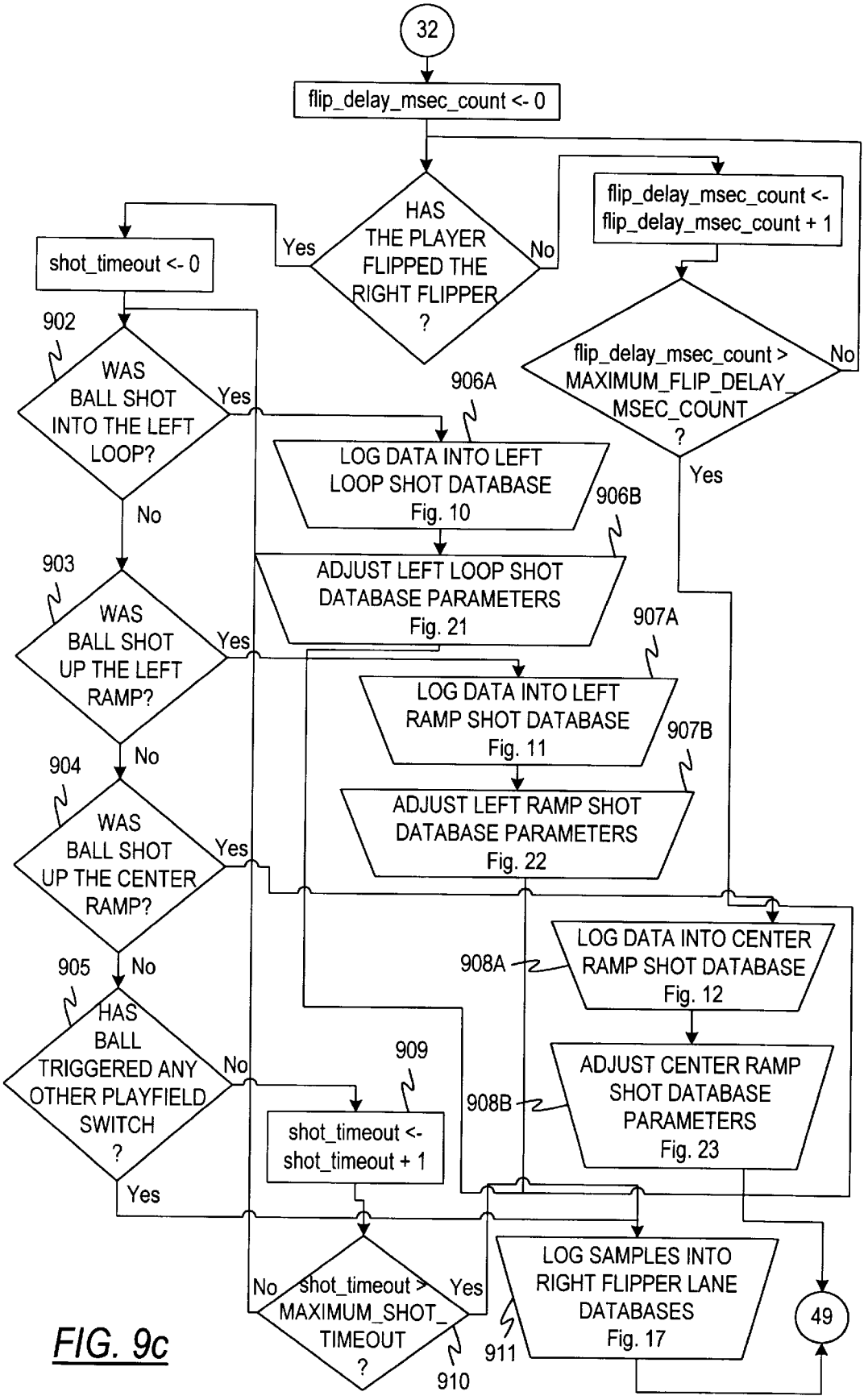
Figure 9D:
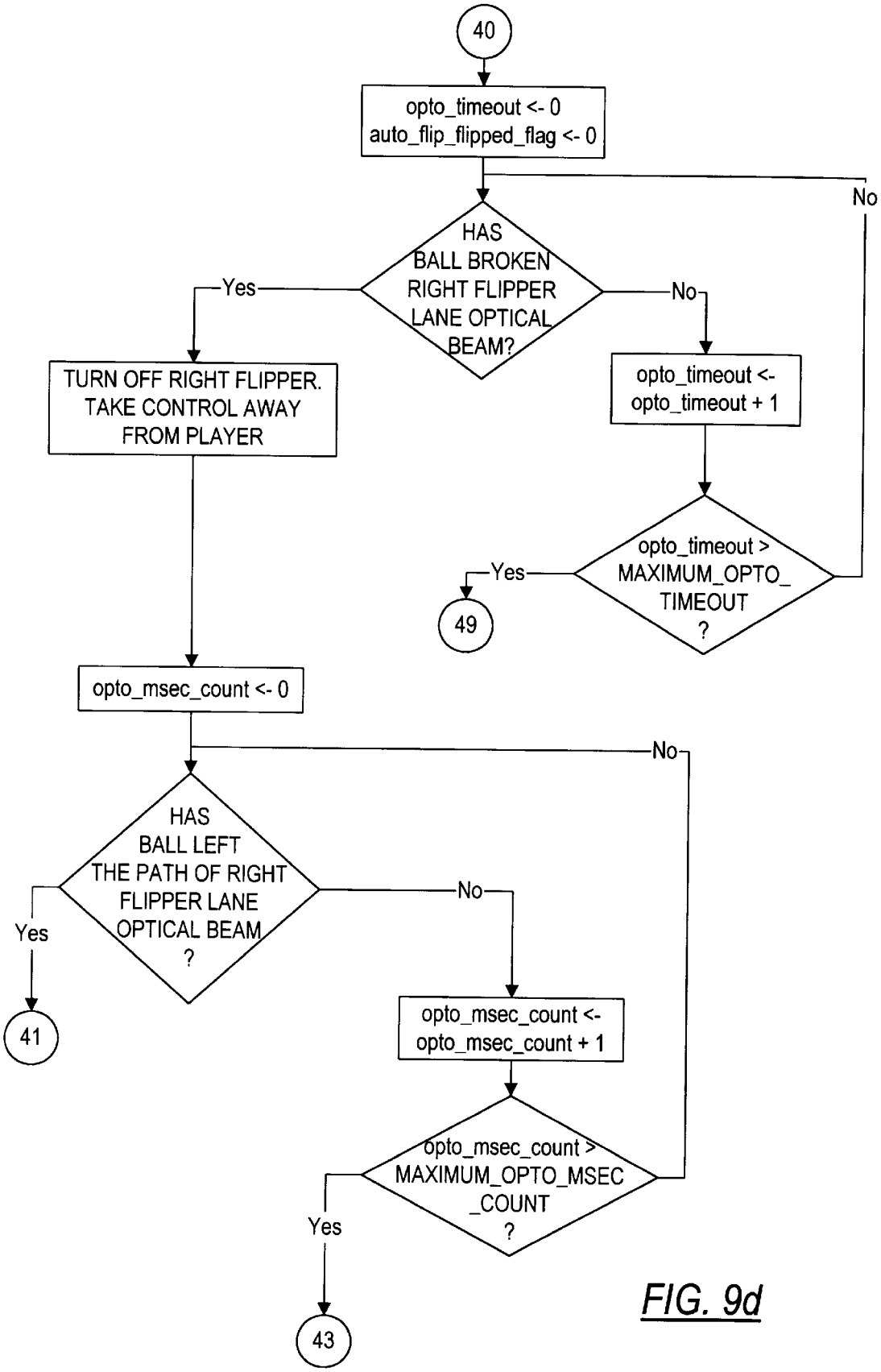
Figure 9E:
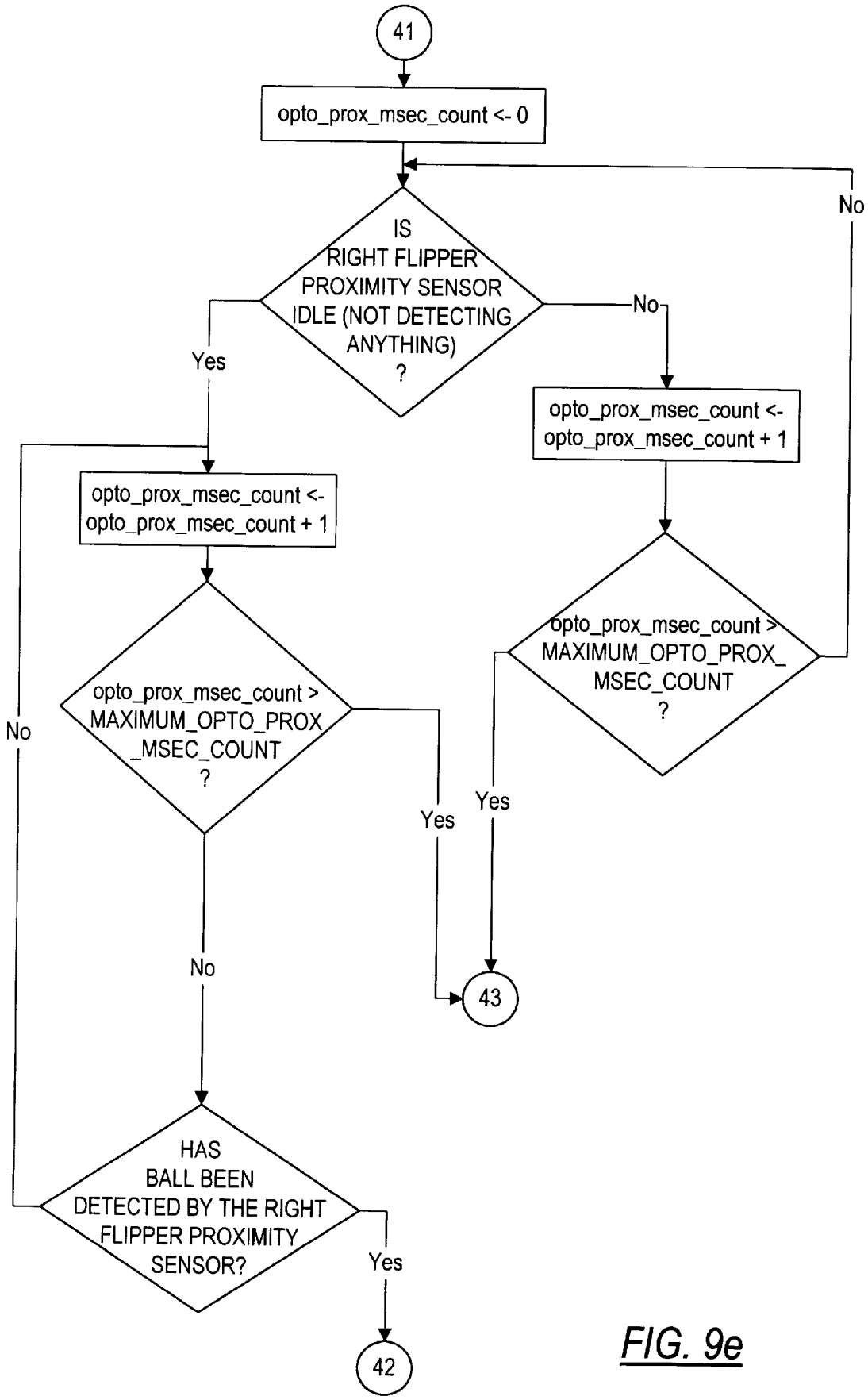
Figure 9F:
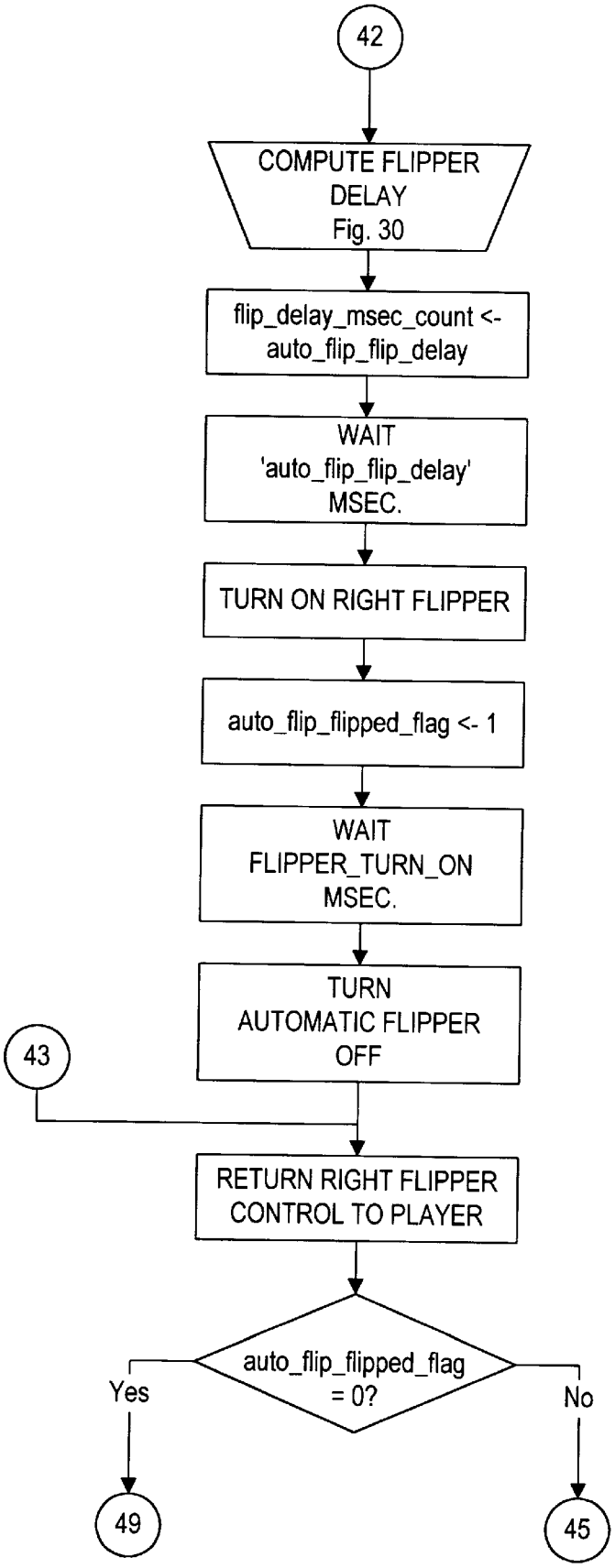

FIGS. 9A–9G shows the program logic for accumulating right flipper auto-flip data from the player and the program logic for a right flipper automatic flip. The figures are divided into two groups: FIGS. 9A–9C deal with a player-controlled flip, while FIGS. 9D–9G deal with an automatic flip. Both flows of logic start with the detection of the ball at the right flipper lane micro-switch (FIG. 4, 408).

The logic for the right flipper (FIGS. 9A–9G) is virtually identical to the logic for the left flipper (FIGS. 8A–8G). The differences are: 1) the physical playfield elements used to determine the data (FIG. 4, 402, 408, 409, 410), 2) the databases used to store and retrieve the data ('left_loop_shot_database', 'left_ramp_shot_database', 'center_ramp_shot_database'), and 3) the targets used to determine whether an automatic right flipper shot was "early", "correct", or "late" (FIG. 4, 411–417).

The deviations of FIGS. 9A–9G from FIGS. 8A–8G that cannot be handled by simple name substitution are described below.

For the logic in FIG. 9A, at 901 it is necessary to select an automatic right flipper shot database ('auto_flip_database'). The databases that can be selected for are 'left_loop_shot_database', 'left_ramp_shot_database', and 'center_ramp_shot_database'.

For the logic in FIG. 9C, checks are made at 902, 903, and 904 to see which of the intended shots defined for the right flipper were hit. If one of the intended shots was hit, the data accumulated for the right flipper by this routine is logged into the appropriate database at 906A, 906B, 907A, 907B, 908A, and 908B. If some other playfield switch was registered at 905, or if the window of time for detecting a shot expires at 909 and 910 (MAXIMUM_SHOT_TIMEOUT, about 1.75 seconds), it is assumed that no shots were hit. In this case, the velocity data samples accumulated by the routine are logged at 911 (if necessary), and the routine ends.

Figure 9G:
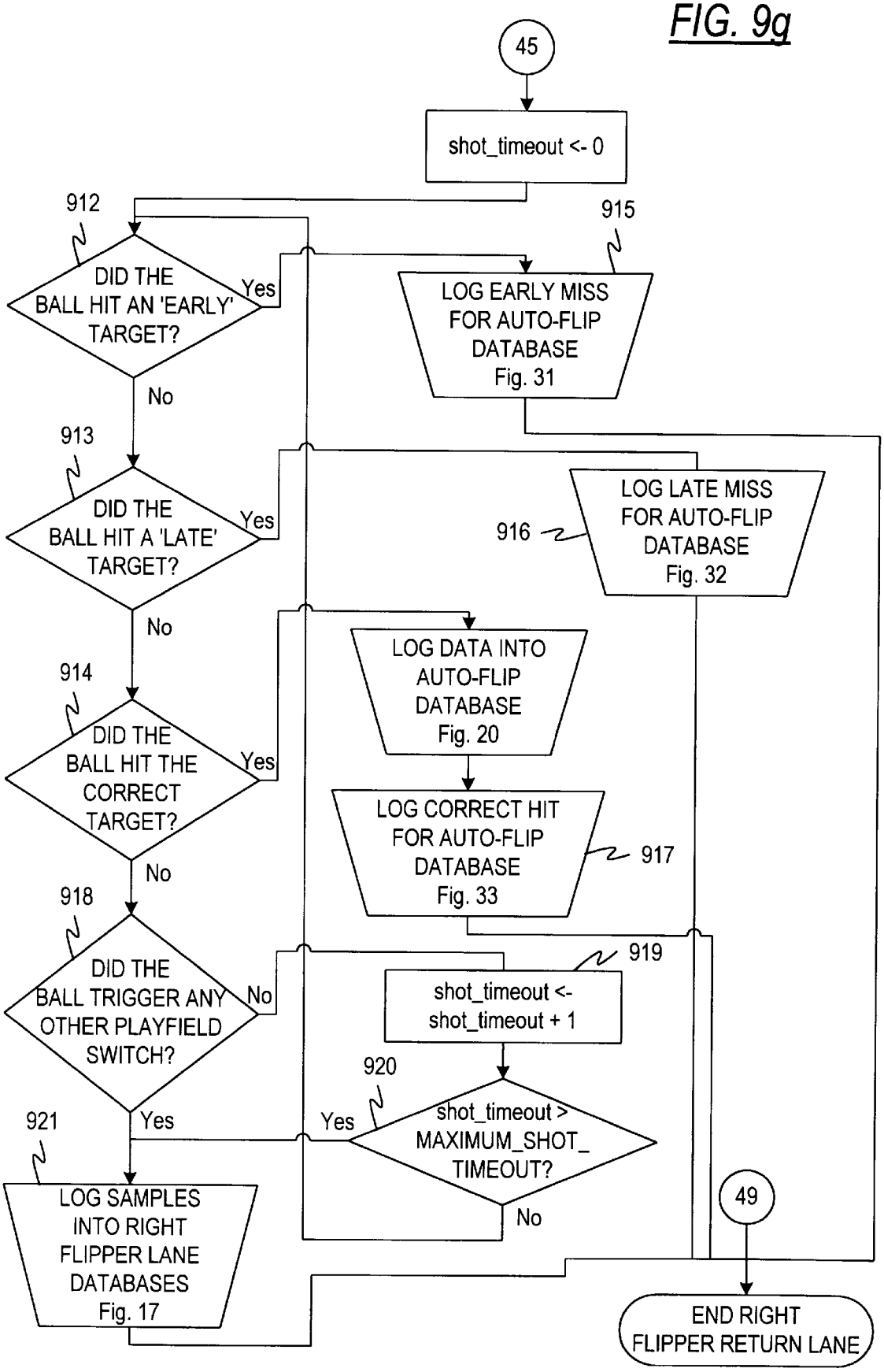
Figure 10:
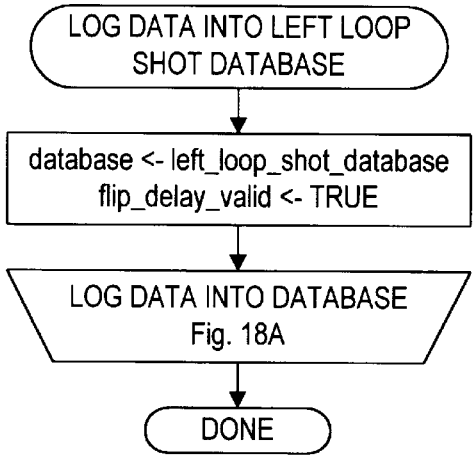
Figure 11:
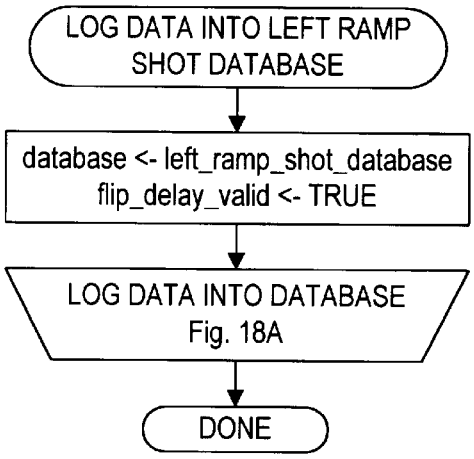
Figure 12:
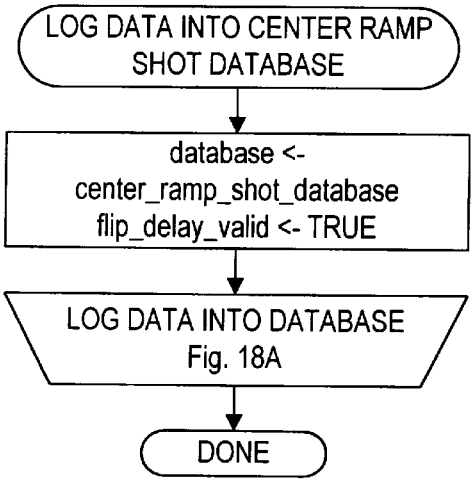
Figure 13:
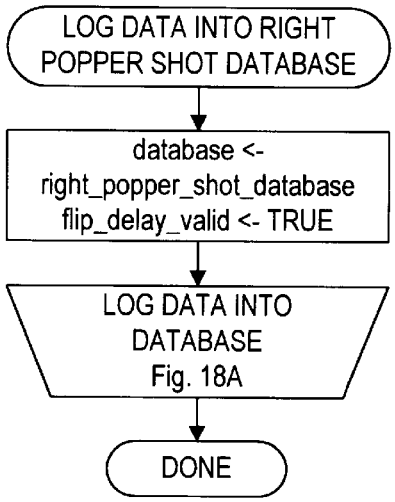
Figure 14:
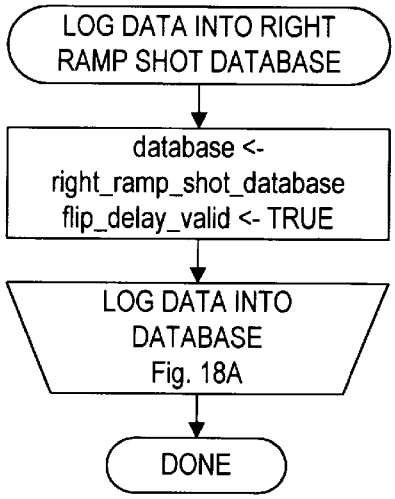
Figure 15:
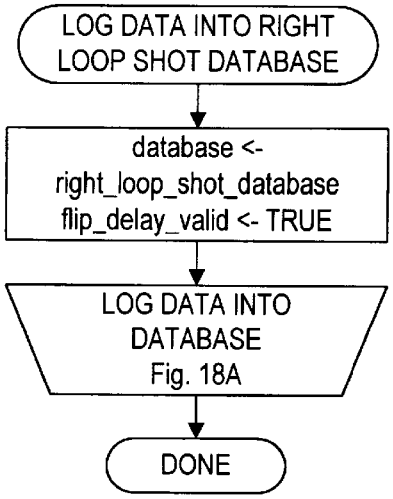

For the logic in FIG. 9G, it is necessary to describe the "early", "correct", and "late" targets for each automatic right flipper database. Each check at 912, 913, and 914 is made with respect to the shot that the automatic right flipper was attempting to hit. If the shot selected in FIG. 9A at 901 was the Left Loop Shot (FIG. 4, 415, 'auto_flip_database'=left_loop_shot_database), then the "early" target is at 411, the "correct" target is at 415, and the "late" target is at 417. It is questionable to use the target at 416 as an "early" target, as it is possible for the automatic right flipper shot to be "late" such that the ball hits the tip of the ball guide between 415 and 417 and ricochets into the target at 416. If the shot selected in FIG. 9A at 901 was the Left Ramp Shot (FIG. 4, 411, 'auto_flip_database'=left_ramp_shot_database), then the "early" target is at 413, the "correct" target is at 411, and the "late" targets are at 416 and 415. If the shot selected in FIG. 9A at 901 was the Center Ramp Shot (FIG. 4, 412, 'auto_flip_database'=center_ramp_shot_database), then the "early" target is at 414, the "correct" target is at 412, and the "late" targets are at 413 and 411.

If it is determined that the ball has hit either an "early", a "late", or a "correct" target, the appropriate action for the target that was hit is taken at 915, 916, or 917. If some other playfield switch was registered at 918, or if the window of time for detecting a shot expires at 919 and 920 (MAXIMUM_SHOT_TIMEOUT, about 1.75 seconds), it is assumed that no useful targets were hit. In this case, the velocity data samples accumulated by the routine are logged at 921 (if necessary), and the routine ends.

If it has been determined that an intended shot has been hit by the player, the data samples that have been collected are logged into the appropriate shot database. The subroutines that handle the logging of the data into the individual databases are illustrated in FIGS. 10–15. Each subroutine sets up a parameter for the appropriate database, and a parameter that indicates whether or not 'flip_delay_msec_count' is valid, and calls the generic "Log Data Into Database" subroutine diagrammed in FIGS. 18A–18D. For the cases in which shots are made by the player, the flip delay value at 'flip_delay_msec_count' is always valid.

Figure 16:
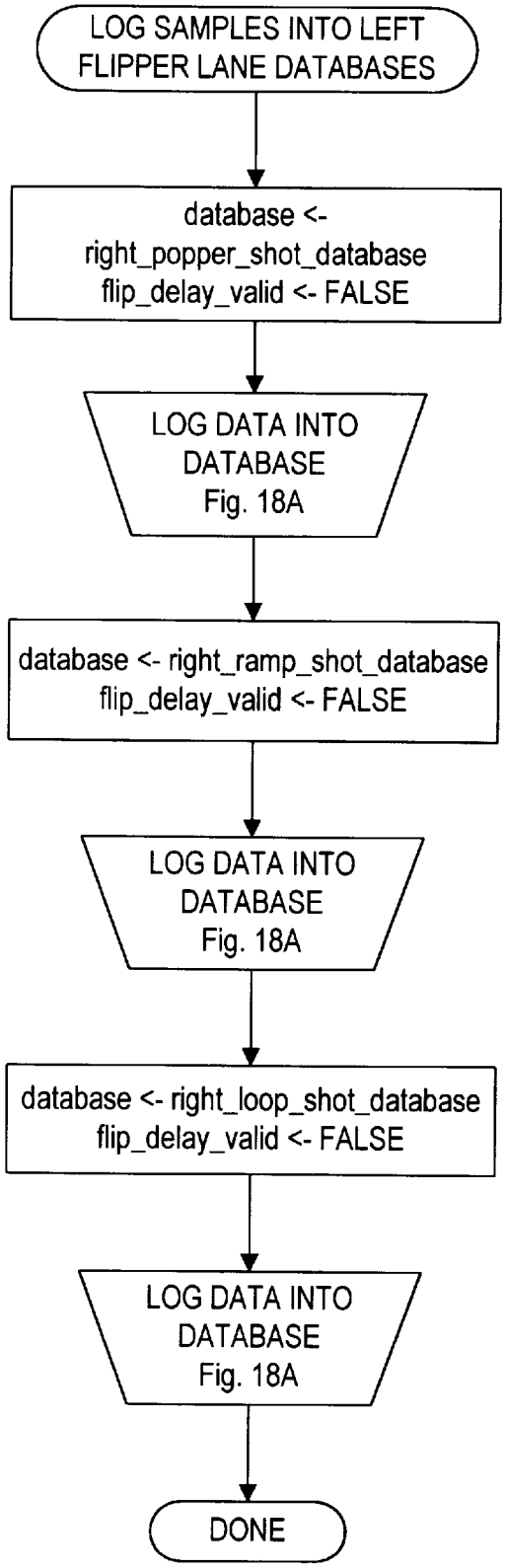
Figure 17:
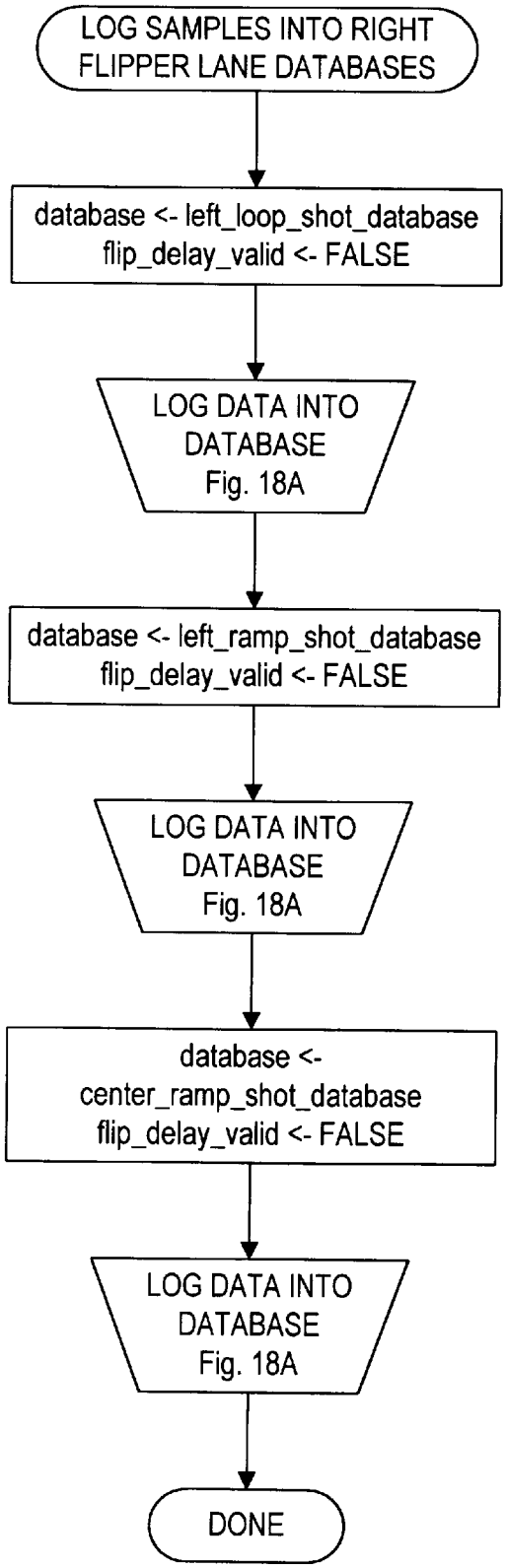

If it has been determined that an intended shot has not been hit by the player or the computer, the data samples that have been collected are logged into all the appropriate shot databases, if necessary. The logging of samples for the left flipper lane databases is illustrated in FIG. 16, and the logging of samples for the right flipper lane databases is illustrated in FIG. 17. The main purpose for logging the data, despite the fact that no accurate flip delay data for an intended shot is present, is to keep reasonable averages for the optical switch time and the optical switch to proximity switch time for the databases associated with the flipper lanes. In FIGS. 16 and 17, the parameter for a valid flip delay ('flip_delay_valid') is set to FALSE to indicate, for each call to the generic data logging procedure, that no accurate flip delay data is available.

Figure 18A:
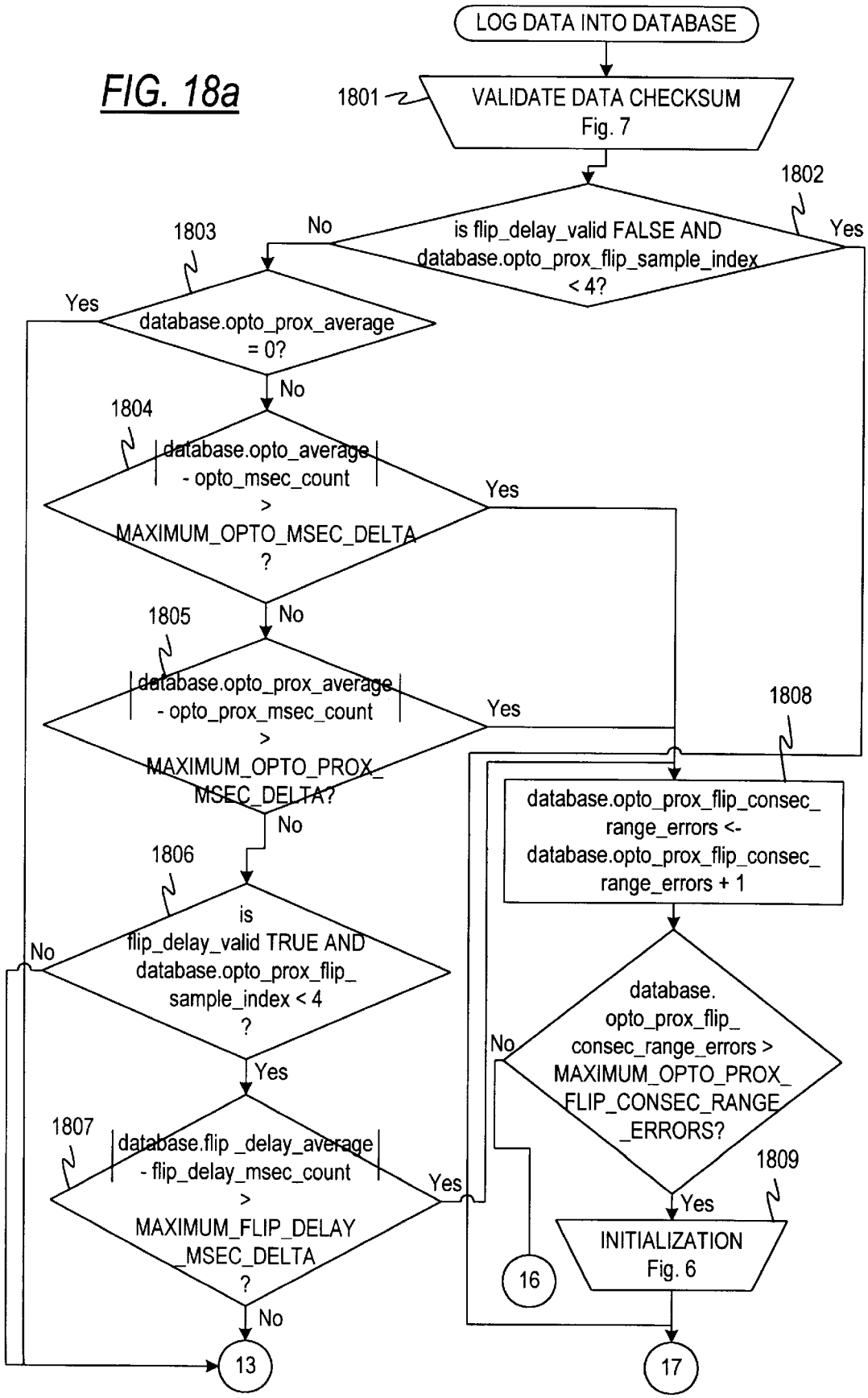

FIG. 18A starts the generic data logging procedure. The database checksum is validated at 1801. Next, a check is made at 1802 to see if the flip delay passed in 'flip_delay_msec_count' is valid or not, and to see if the sample index 'opto_prox_flip_sample_index' is less than 4. This routine is only interested in logging the sample data handed to it if the flip delay passed to it is valid, or if the sample index is greater than or equal to 4. If there is no valid flip delay and the sample index for the database is less than 4, the routine ends. At 1803, the member variable 'opto_prox_average' (the average velocity) is examined to see if it is zero. If the value is zero, then the database in question has not seen enough data samples to compute the averages; the branch at 13 is then taken to add the data sample to the database. If the value is non-zero, then the checks at 1804 and 1805 are performed to ensure that the data about to be logged into the database is reasonably valid. The check at 1804 ensures that the optical switch time sample is within 30 milliseconds of either side of its average time in the database. The check at 1805 ensures that the optical switch to proximity switch time sample is within 60 milliseconds of either side of its average time in the database. The check at 1807 ensures that the flip delay time sample (if valid) is within 20 milliseconds of either side of its average in the database. If one of the checks at 1804, 1805, or 1807 fails, the number of consecutive data range errors is increased at 1808 and the database is reset at 1809 if there are too many errors. This can occur if the signals from either the optical switches or the proximity switches for the flippers are intermittent. If a data range error occurs, the routine ends at either 16 or 17. At 1806, a check is made to see if the flip delay passed to the routine is valid, and if the sample index is less than 4. If these conditions are met, then the call to the routine is one that results in the logging of the flip delay data 'flip_delay_msec_count', and the delay value must then be checked at 1806 to make sure that it is in range.

Figure 18B:
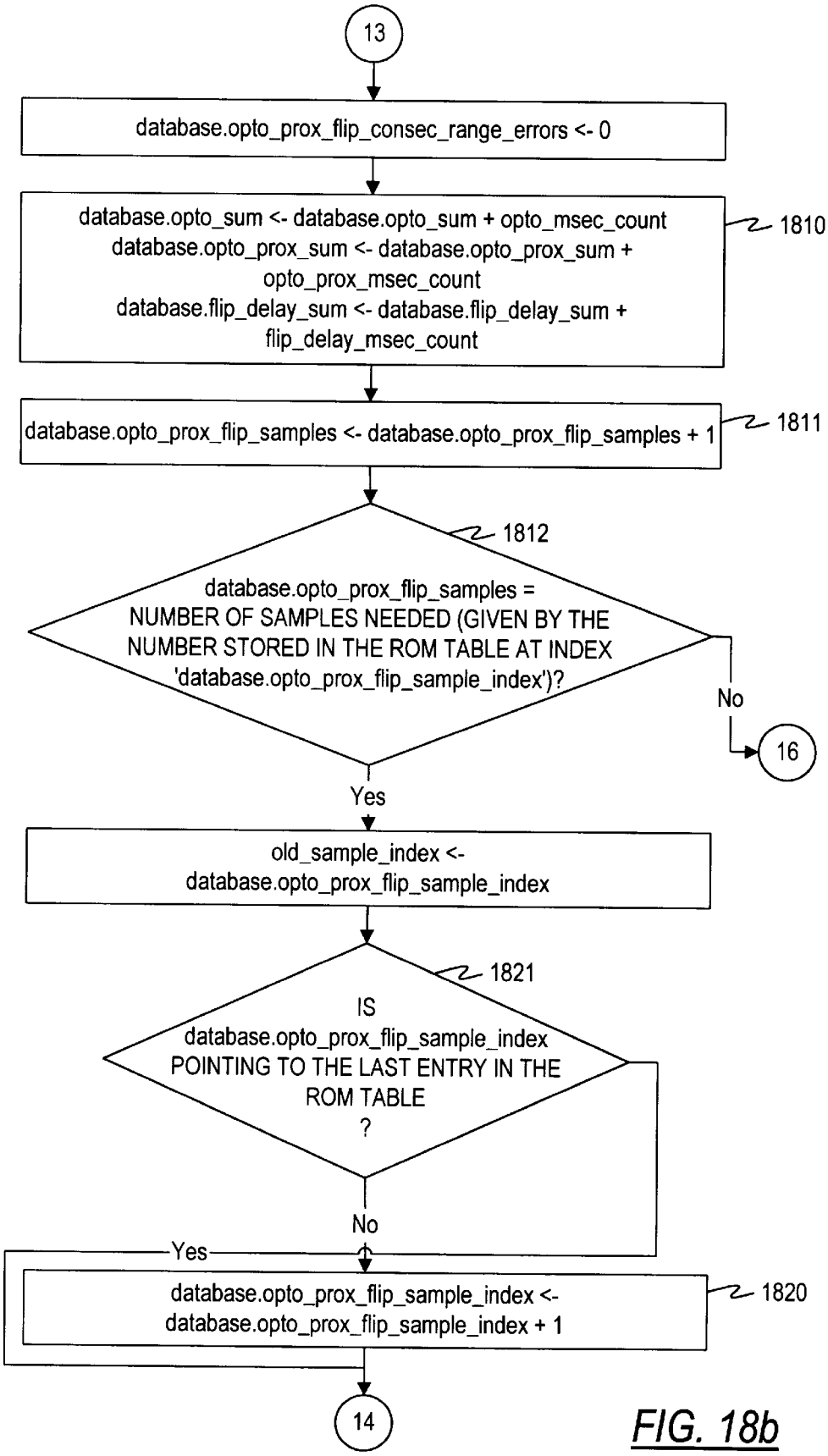

If the data is determined to be reasonable, the samples are added to the database in FIG. 18B. Each piece of data is added to an appropriate sum in 1810, and the number of samples collected is increased at 1811. At 1812, the sample index is used to perform a lookup in a table (array) to see if there are enough samples to compute new averages for the data. The entries in this table are as follows: 2, 2, 2, 2, 4, 8, and 16. When the sample index is 0 (its value after Initialization, FIG. 6), no averages exist and the first set of averages are computed with 2 samples. This allows the automatic flip feature to be activated for a shot with only 2 samples. When the sample index is 1, 2, or 3, the averages are also computed with 2 samples. When the sample index is 4 or more, additional samples are needed to establish new averages, which tends to stabilize the averages more toward their long-term averages.

If there are not enough samples to compute the new averages, the routine ends. If there are enough samples, the sample index is increased at 1820, except when it is referring to the last entry in the sample table at 1821. The new averages are computed in FIG. 18C. At 1813, 1814, and 1815, it is determined if an average for the individual data already exists. If not, the new average is simply computed and stored at 1825, 1826, and 1827. If so, the new average is computed and averaged with the old average at 1822, 1823, and 1824.

Computing the new flip delay average is handled in one of two ways by the check made at 1816. If the previous value of the sample index is less than 4, then the flip delay average is computed starting at 1815. If the previous value of the sample index is greater than or equal to 4, then the new flip delay average is calculated from the old average at 1817. The reason for handling the calculation of the new flip delay average in this manner is a result of the progression of the required number of samples needed to arrive at the new averages, and the difference in the volatility of the velocity and the flip delay. The sample table is arranged such that after the fourth average is computed, a greater number of samples are required to compute new averages. When more samples are required, the average of the samples collected tends to more accurately reflect what the average would be in the long term. A long-term average generally works well for the ball velocity, as the flipper lane ball guide delivers the ball fairly consistently to the flippers. The flip delay, however, can vary considerably over the course of a short period of time. As the flipper solenoids are activated many times, their power tends to degrade slightly as heat builds up and additional friction between the plunger and the coil sleeve is generated. This tends to cause the flip delay to drift to the "late" side over the course of a single game or many games. If the flip delay were to continue to be averaged here, as the number of samples required to compute the new averages increased, the average flip delay would regularly not be recalculated often enough to result in accurate automatic flipper shots. Thus, it is desirable to adjust the flip delay average more frequently than the velocity average. This is handled in FIG. 27.

Once the new averages have been computed, the flip delay scalar is computed at 1818. This value, divided by 256, represents the rate at which to scale the flip delay average when the velocity of the ball from the optical switch to the proximity switch is over or under the average velocity ('opto_prox_average'). Assuming a constant velocity system, the flip delay to use for an automatic flip is given by the ratio:

ti (opto_prox_average/opto_prox_msec_count)=(flip_delay_average/flip_delay_msec_count)

Solving for 'flip_delay_msec_count' (which is what is desired when doing the calculation for an auto-flip), and rearranging terms, results in:

flip_delay_msec_count=opto_prox_msec_count*(flip_delay_average/opto_prox_average)

The expression '(flip_delay_average/opto_prox_average)' is the flip delay scalar. It is used to calculate the flip delay for an automatic flip by "scaling" the measured velocity of the ball from the optical switch to the proximity switch (opto_prox_msec_count). The ball velocity determines the magnitude of the flip delay, since the flip delay scalar is a ratio of averages that evaluates to a constant (the values for 'flip_delay_average' and 'opto_prox_average' are retrieved from the database when an automatic flip is to occur). Longer times measured for 'opto_prox_msec_count' (slow ball velocity) will result in longer times for the flip delay; shorter times measured for 'opto_prox_msec_count' (fast ball velocity) will result in shorter times for the flip delay. After the flip delay scalar is computed, the sums and number of samples are cleared in FIG. 18D at 1819, a checksum for the database is computed and stored, and the routine ends.

Figure 18C:
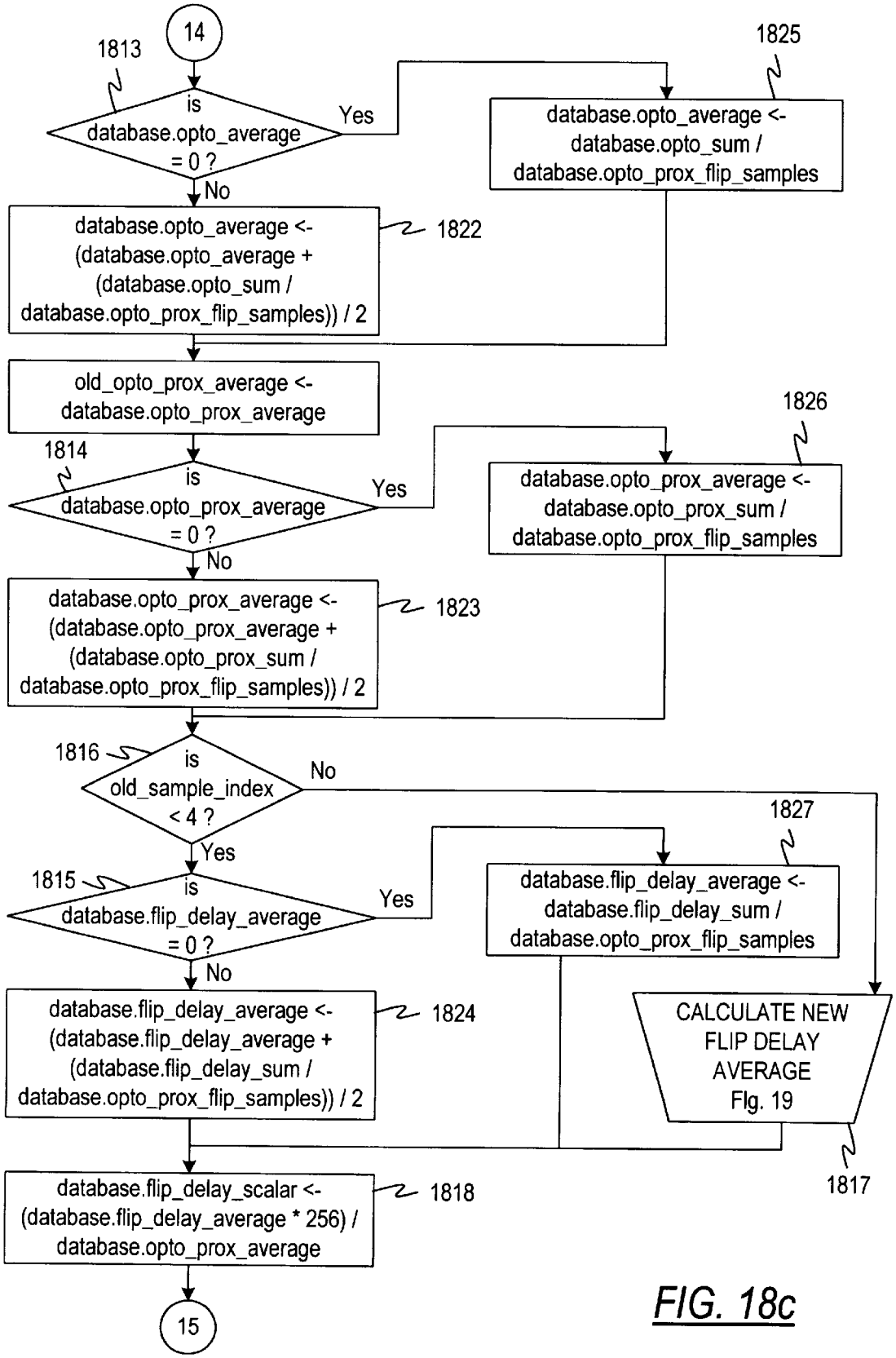
Figure 18D:
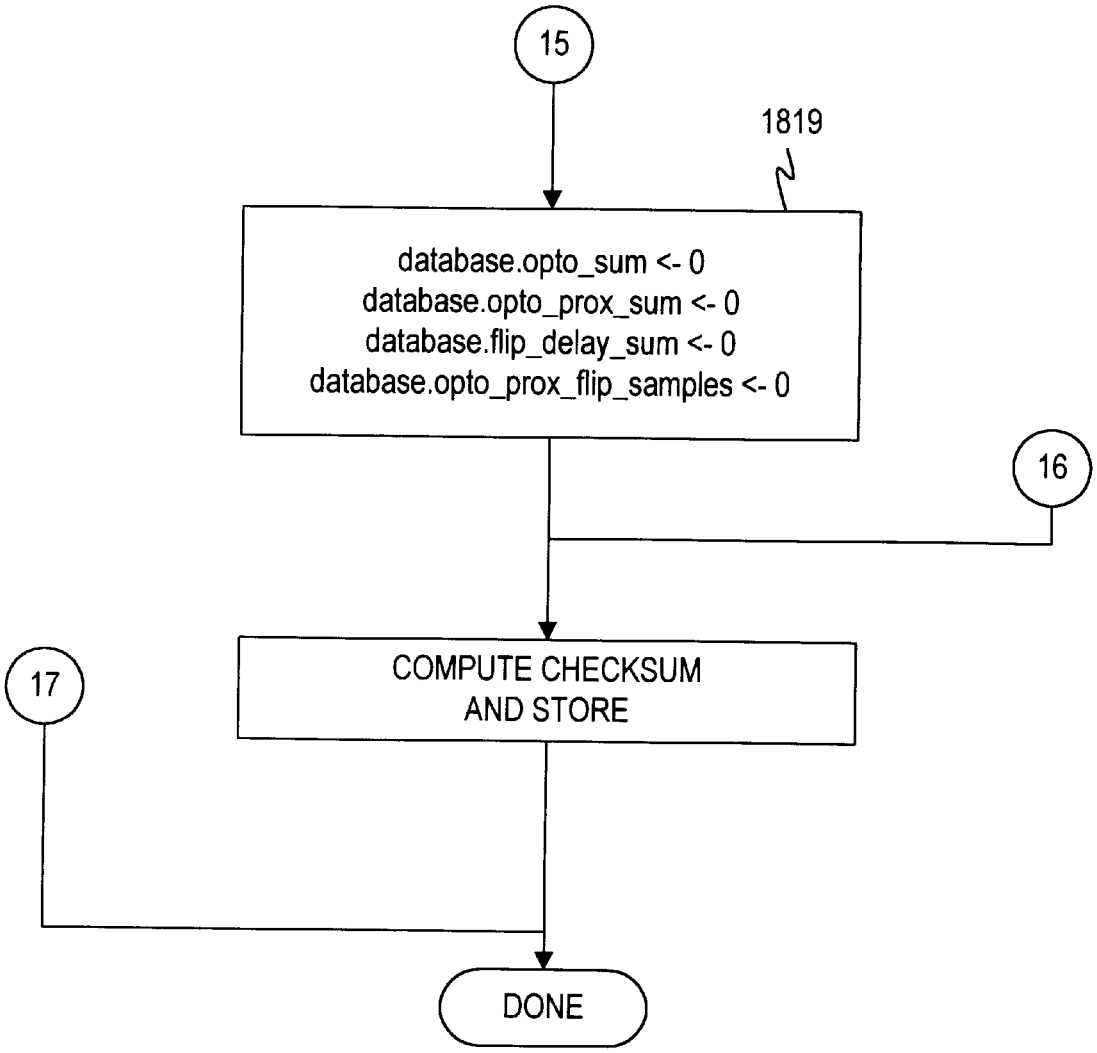
Figure 19:
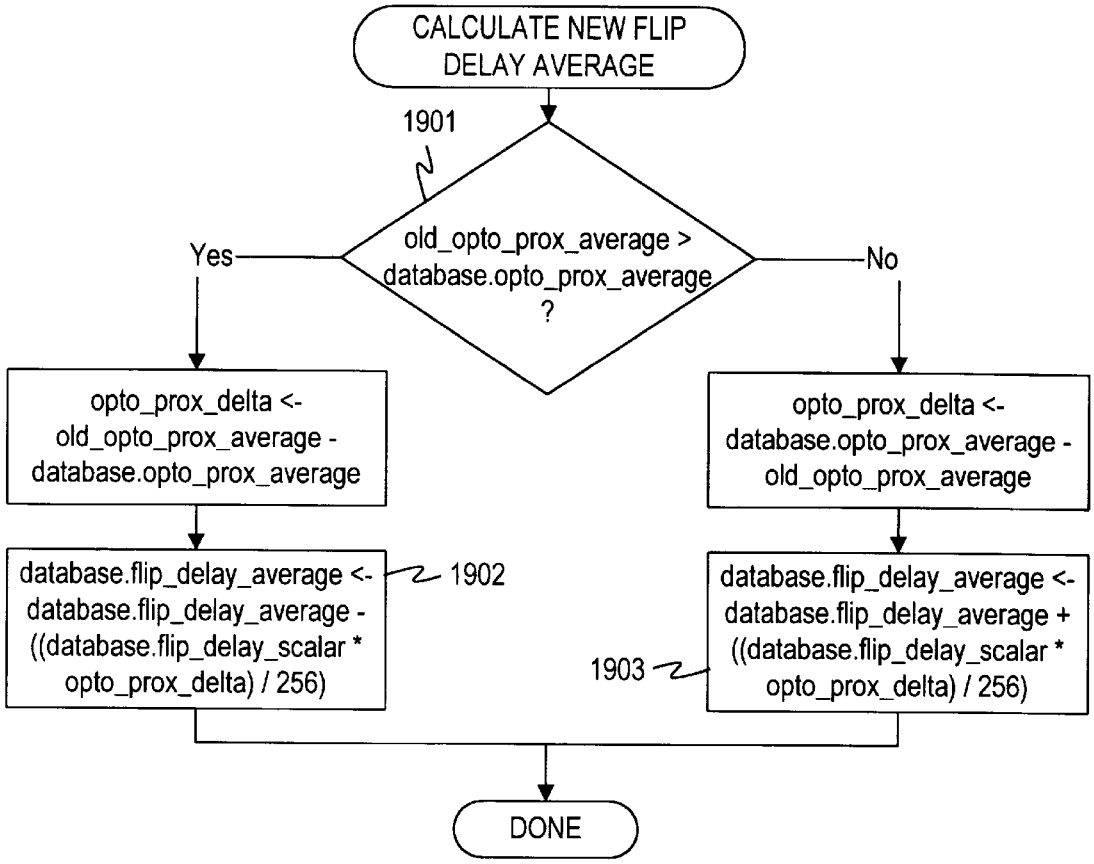

FIG. 19 illustrates the routine to calculate a new flip delay average, which is called from FIG. 18C at 1817. Once the generic data logging procedure (FIGS. 18A–18D) has accumulated enough blocks of samples of data (4 or more), the flip delay average is no longer calculated from the flip delay sums stored in the database. Rather, the new flip delay average is calculated based on how far off the new "optical switch to proximity switch average" is from the old time. If the new optical switch to proximity switch average is smaller than the old average at 1901, the difference in times (in flip delay units) is subtracted from the flip delay average at 1902. If the new optical switch to proximity switch average is larger than the old average at 1901, the difference in times (in flip delay units) is added to the flip delay average at 1903.

Figure 20:
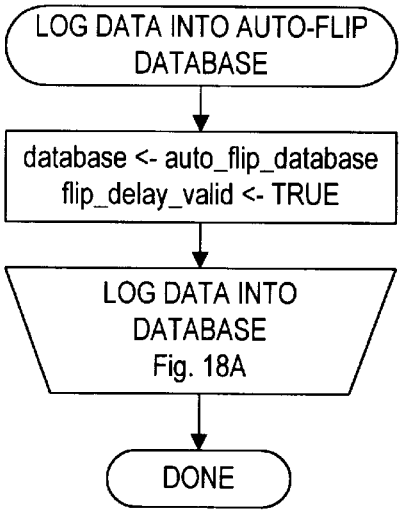
Figure 21:
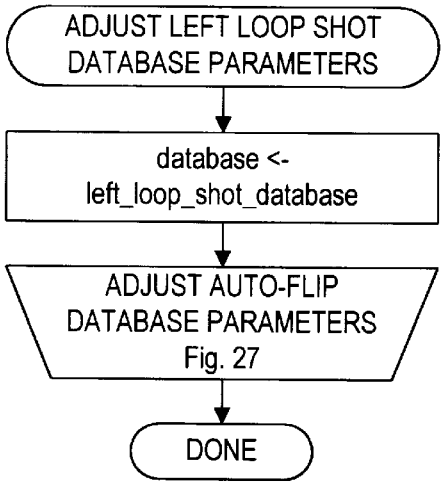
Figure 22:
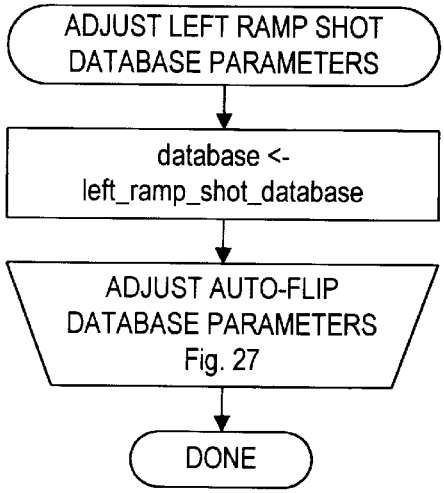
Figure 23:
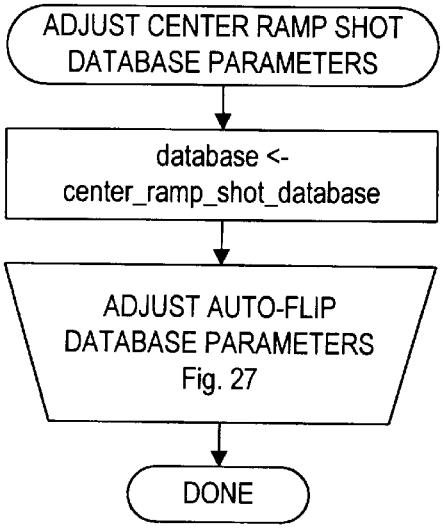
Figure 24:
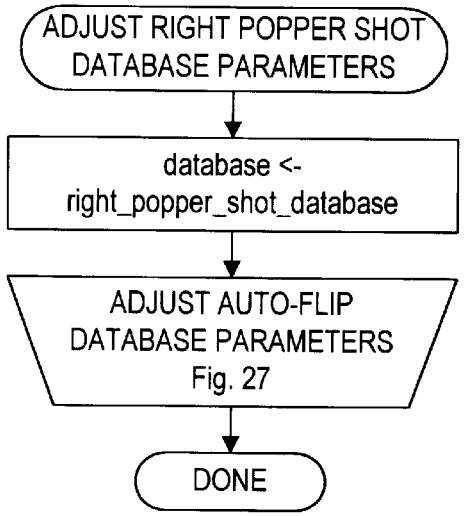
Figure 25:
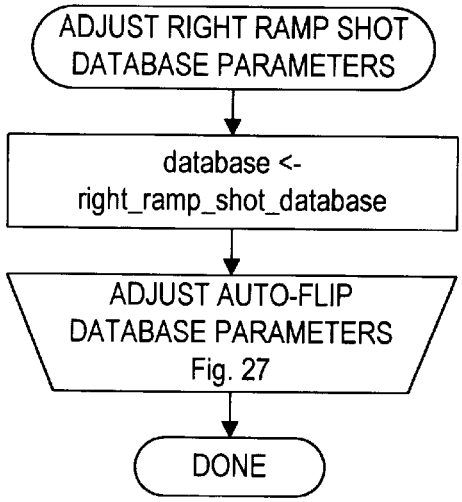
Figure 26:
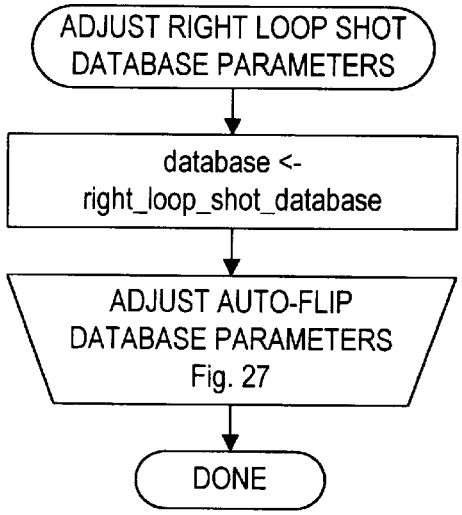

If it has been determined that an intended shot has been hit by the computer, the data samples that have been collected are logged into the appropriate shot database (FIG. 20). The subroutine sets up a parameter for the appropriate database, and a parameter that indicates whether or not 'flip_delay_msec_count' is valid, and calls the generic "Log Data Into Database" subroutine diagrammed in FIGS. 18A–18D. For the cases in which intended shots are made by the computer, the flip delay value at 'flip_delay_msec_count' is always valid.

FIGS. 21–26 show the routines that are called to adjust the automatic flipper database parameters when an intended shot has been made by the player. These routines are called from 906B, 907B, 908B in FIG. 9C, and from 829B, 830B, 831B in FIG. 8C. The purpose of these routines is to verify that the data in the automatic flipper database for the intended shot made by the player is accurate. Each routine sets up a parameter to the database in question and calls the generic "Adjust Auto-Flip Database Parameters" routine.

Figure 27:
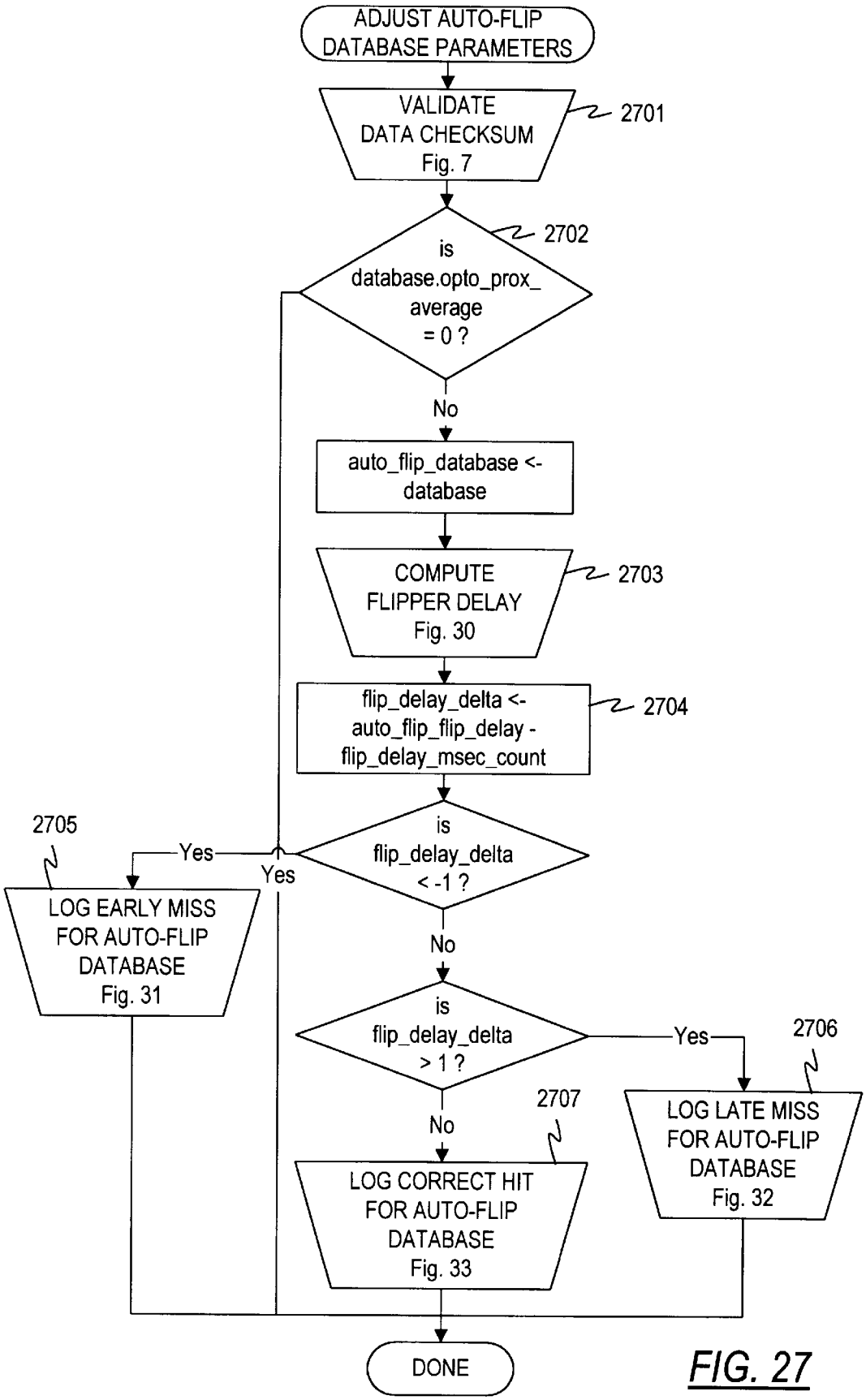

FIG. 27 shows the "Adjust Auto-Flip Database Parameters" routine. The database checksum is validated at 2701. At 2702, a check is made to see if an average has been computed for the optical switch to proximity switch time; if not, the routine ends. If an average has been established, the flip delay time for the data in the database is computed at 2703 from 'opto_prox_msec_count', as if an automatic flip were to occur for this target. At 2704, the difference in flip delay times is calculated. This difference, stored at 'flip_delay_delta', indicates how far away the calculated flip delay time is from the flip delay time seen by the player's correct shot. If the difference is less than −1, this indicates that were an automatic flip to occur with this data, the flip delay time calculated would have been too small, resulting in a flip that was too early. In this case, an early miss is logged at 2705. If the difference is greater than 1, this indicates that were an automatic flip to occur with this data, the flip delay time calculated would have been too large, resulting in a flip that was too late. In this case, a late miss is logged at 2706. If the calculated flip delay time and the actual flip delay time from the player shot are within 1 millisecond of each other, this indicates that were an automatic flip to occur with this data, the flip delay time would have been correct, resulting in a correct hit. In this case, a correct hit is logged at 2707.

Figure 28:
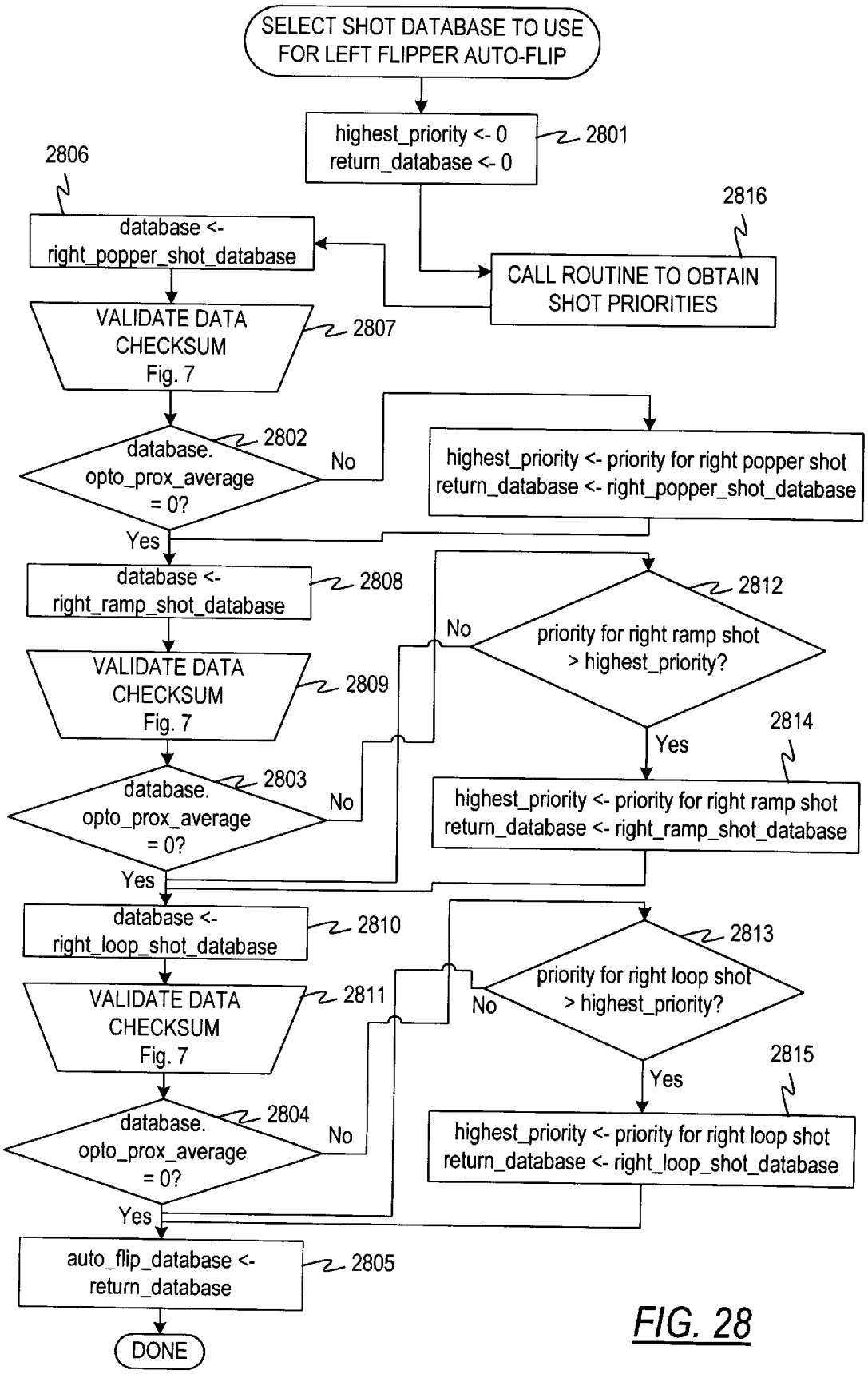
Figure 29:
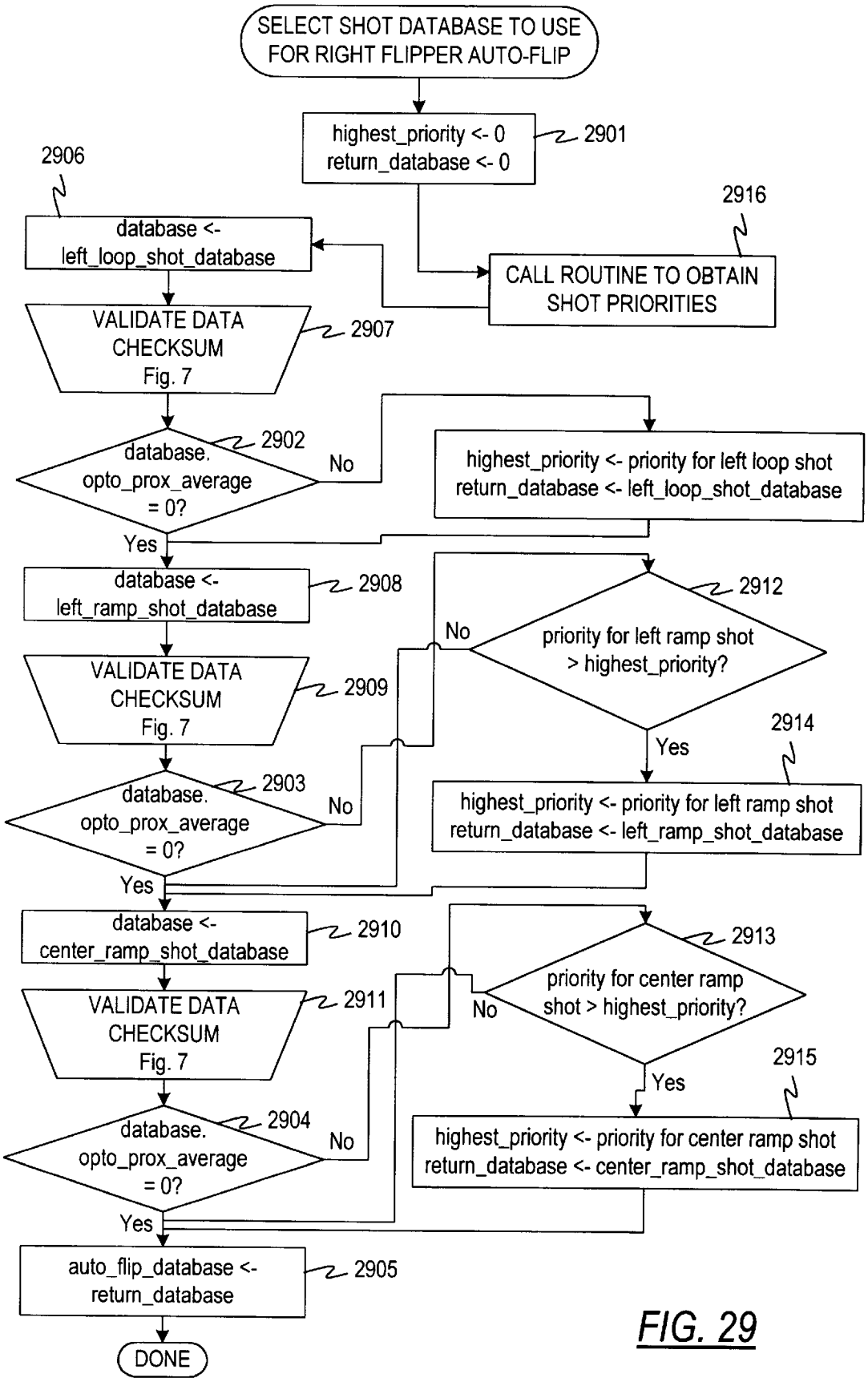

FIGS. 28 and 29 detail the some of the logic for selecting a shot database to use for a left flipper and a right flipper auto-flip, respectively. A priority scheme is used for determining the shot that should be used for the auto-flip; the database with the highest priority associated with it is the database that will be used. The priority assigned to a shot depends upon the game situation, such as whether the shot would yield an extra ball, a multi-ball event, a bonus, a higher score, etc. In FIG. 28 at 2801 and FIG. 29 at 2901, 'highest_priority' and 'return_database' are initialized to zero, which indicates that no high priority has been seen so far, and that there is no database yet to be returned. Next, in FIG. 28 at 2816 and in FIG. 29 at 2916, a subroutine is called to obtain the current priority values assigned to the different shots based on the aforementioned priority scheme. The checks in FIG. 28 at 2802, 2803, 2804 and in FIG. 29 at 2902, 2903, 2904 are performed to verify that there is data in the database to attempt to make the shot in question. If the average velocity for the database is zero, then there is no shot data in the database and the database cannot be considered for use (see steps 2806 through 2811 in FIG. 28 and steps 2906 through 2911 in FIG. 29). If the average velocity is non-zero, then the priority for the shot is checked against 'highest_priority' at 2812 and 2813 in FIG. 28 and 2912 and 2913 in FIG. 29. If the priority associated with the shot in question is higher than 'highest_priority', then 'highest_priority' is set to this higher priority and 'return_database' is set to the database for the shot in question at 2814 and 2815 in FIG. 28 and 2914 and 2915 in FIG. 29. This process continues until all shot databases for the flipper have been examined. At the end of the routines in FIG. 28 at 2805 and FIG. 29 at 2905, 'auto_flip_database' is set to the database that was found, and the routine ends.

Note that it is possible for the subroutines illustrated in FIGS. 28 and 29 to fail to select a valid shot database. This can happen when all of the shot databases have a zero value for the average velocity ('opto_prox_average'), usually after an Initialization (FIG. 6). It is also possible for the routines to return a shot database that does not correspond to the shot that is the most "valuable" to the player. Again, this can happen when the database for the shot in question has a zero value for the average velocity ('opto_prox_average'), again typically after an Initialization (FIG. 6).

Figure 30:
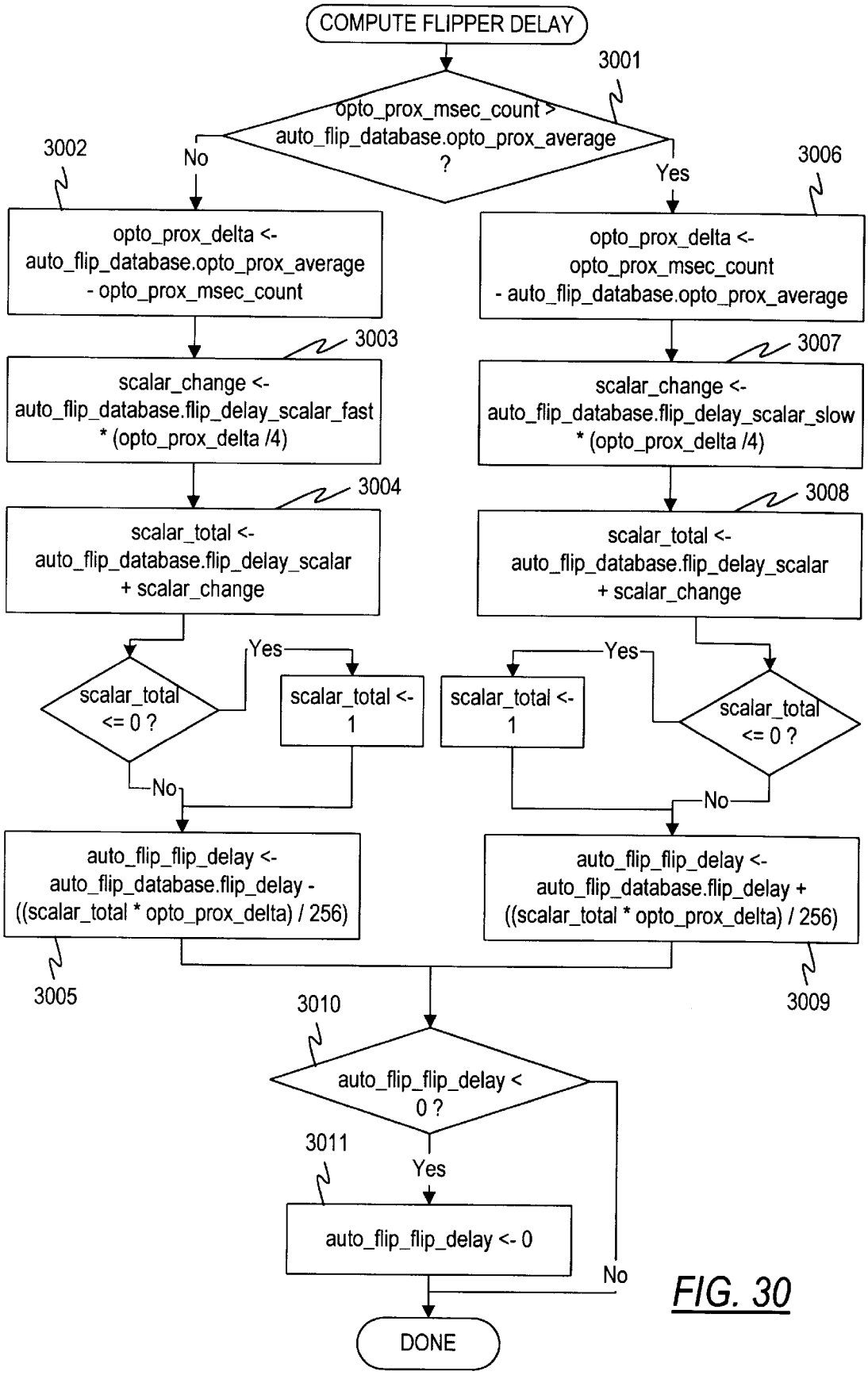

FIG. 30 shows the logic for computing the flipper delay when an automatic flip is to occur for either the left flipper or the right flipper. At 3001, a determination is made as to whether the time it took the ball to travel from the trailing edge of the flipper lane optical beam to the leading edge of the flipper proximity switch is more or less than the average time given by 'opto_prox_average'. If the ball takes less time to travel this distance than the average time, the difference in time (computed at 3002), multiplied by the total scalar (computed at 3004), divided by 256, is subtracted from the average flip delay at 3005. If the ball takes more time to travel this distance than the average time, the difference in time (computed at 3006), multiplied by the total scalar (computed at 3008), divided by 256, is added to the average flip delay at 3009. The result is a decrease in the flip delay from the average for times that are shorter than average, and an increase in the flip delay from the average for times that are longer than average.

The value of 'scalar_total', computed at 3004 and 3008, varies based on the values that 'flip_delay_scalar_fast' and 'flip_delay_scalar_slow' can assume. The values of these shot database variables are set to predetermined values at initialization and adjusted according to feedback from shots that are "early", "correct", or "late". These two parameters usually only significantly affect the result of the calculation of the flip delay when the ball velocity is far from the average. It is necessary, especially with unusually small or large values for the current velocity, for the computed flip delay to be shorter or longer than it would be if only the value of the flip delay scalar were used in the computation. When the ball is traveling at a high rate of speed, it is necessary to compensate for the amount of time it takes for the flipper to bring itself from the rest position to the raised position relative to this speed. Since the flipper does not raise itself instantaneously, a ball with greater speed will travel further along the flipper while the flipper is in the process of being raised than a ball with a smaller speed. If only the 'flip_delay_scalar' parameter is used in the computation of the flip delay, this will often result in the ball striking a "late" target. A similar but exactly opposite argument can be made for the cases where the current velocity is unusually large.

At 3003 and 3007, 'scalar_change' is computed. For times that are shorter than average, 'flip_delay_scalar_fast' (default value=4) is multiplied by one quarter of the difference in time at 3003 and added to the flip delay scalar at 3004. For times that are longer than average 'flip_delay_scalar_slow' (default value=2) is multiplied by one quarter of the difference in time at 3007 and added to the flip delay scalar at 3008. The flip delay for the auto-flip is calculated and stored either at 3005 (for smaller than average times) or at 3009 (for larger than average times), and the routine ends after a validity check on the computed flip delay at 3010 and 3011.

Figure 31:
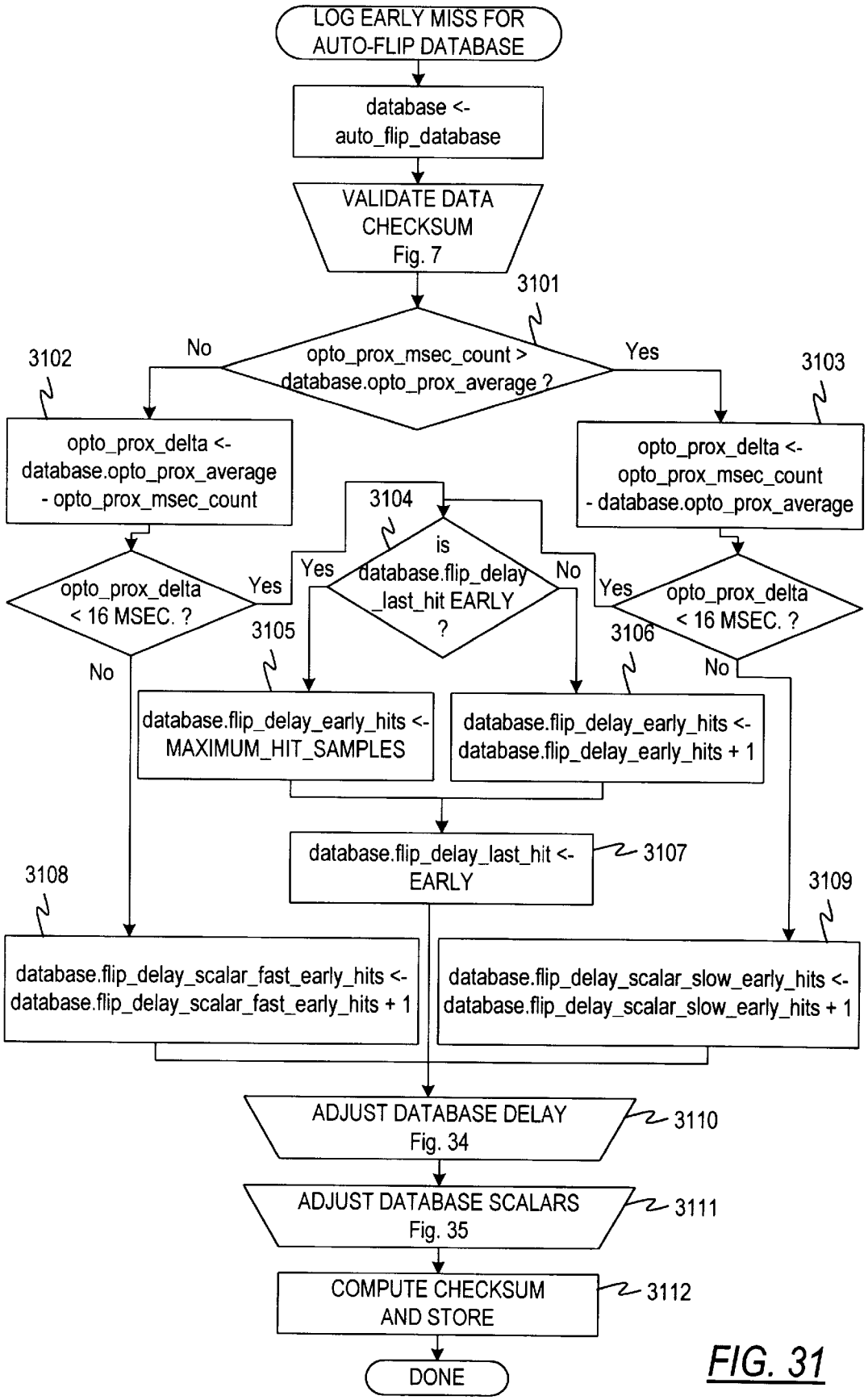

FIG. 31 illustrates the logic flow for logging an early miss into a shot database. This miss is one in which the flip delay time calculated was too small, resulting in a flip that was too early for the intended target. At 3101, a check is made to see if the time it took the ball to travel from the trailing edge of the flipper lane optical beam to the leading edge of the flipper proximity switch was more or less than the average time given by 'opto_prox_average'. If the ball took less time to travel this distance than the average time, the difference in time is computed at 3102. If the ball took more time to travel this distance than the average time, the difference in time is computed at 3103. If the difference was close to the average (less than 16 milliseconds), the status of the previous hit for the database is checked at 3104 to see if it was also early. If the previous hit was also early, the database member 'flip_delay_early_hits' is set to 'MAXIMUM_HIT_SAMPLES' (4) at 3105. This allows the routine diagrammed in FIG. 34 to adjust the flip delay more quickly, as two consecutive early hits likely indicates that the flip delay is indeed too small. If the previous hit was not also early, the database member 'flip_delay_early_hits' is simply incremented at 3106. The member 'flip_delay_last_hit' is then set to 'EARLY' at 3107, indicating that the last known hit for this shot was "early".

If the computed difference ('opto_prox_delta') was far from the average (greater than or equal to 16 milliseconds), one of the scalar early hit database members is modified at 3108 or 3109, depending on whether or not the ball took more or less time to travel the distance, based on the average. If the ball took less time than the average, the database member 'flip_delay_scalar_fast_early_hits' is incremented at 3108. If the ball took more time than the average, the database member 'flip_delay_scalar_slow_early_hits' is incremented at 3109.

If one of the database member variables was modified, the subroutines at 3110 and 3111 are called. These subroutines check the distribution of hits (either "early", "correct", or "late") and adjust the values of the average flip delay and the fast and slow flip delay scalars as necessary. A checksum is computed at 3112 and the routine ends.

Figure 32:
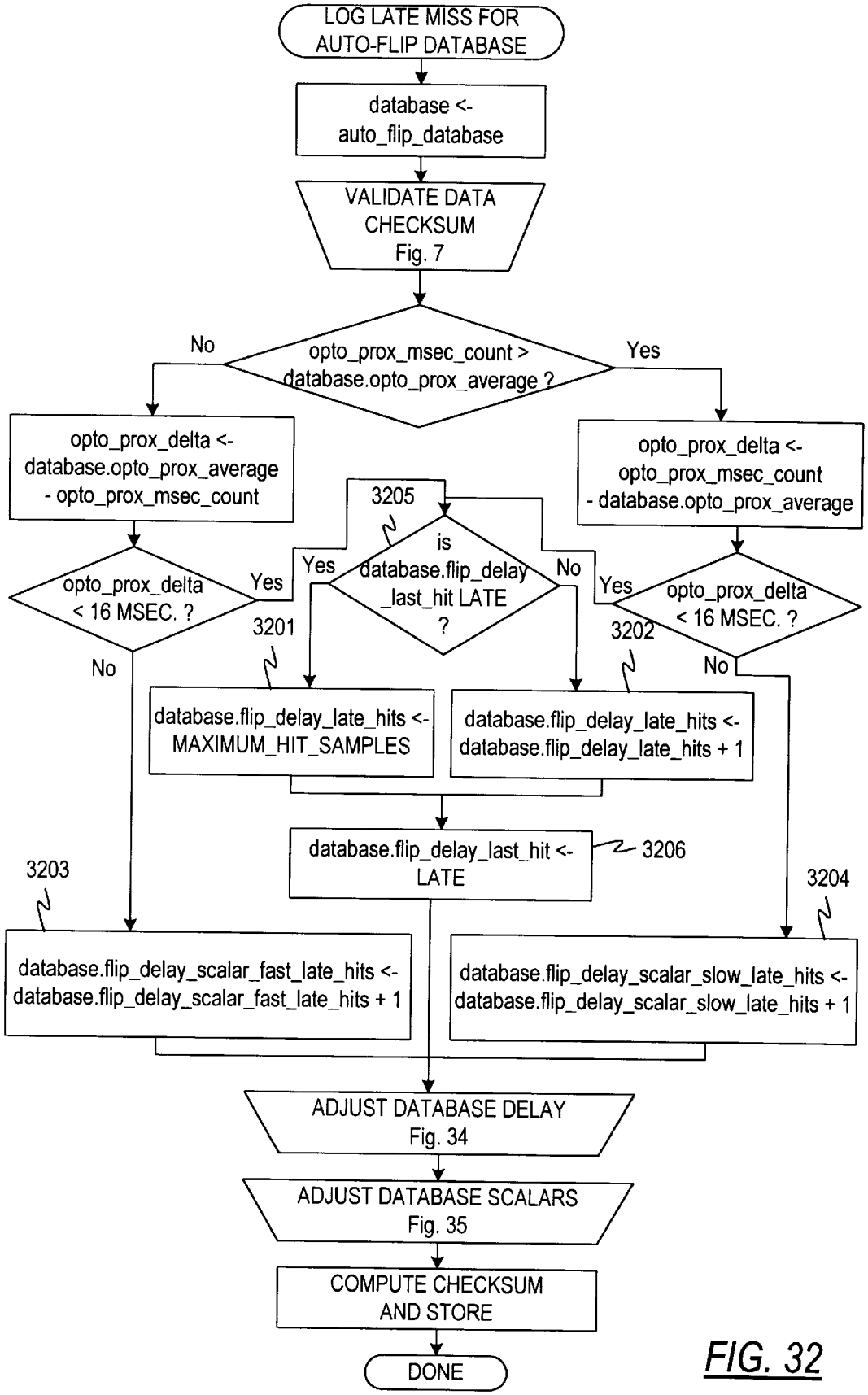

FIG. 32 illustrates the logic flow for logging a late miss into a shot database. This miss is one in which the flip delay time calculated was too large, resulting in a flip that was too late for the intended target. It is similar to FIG. 31; the major differences are at 3201, 3202, 3203, 3204, 3205, and 3206. At 3201, 3202, 3203, and 3204, the database member variables that are modified are the ones that pertain to "late" hits. At 3205 the check is made for the previous hit being "late", and at 3206 the previous hit is set to 'LATE', indicating that the last known hit for this shot was "late".

Figure 33:
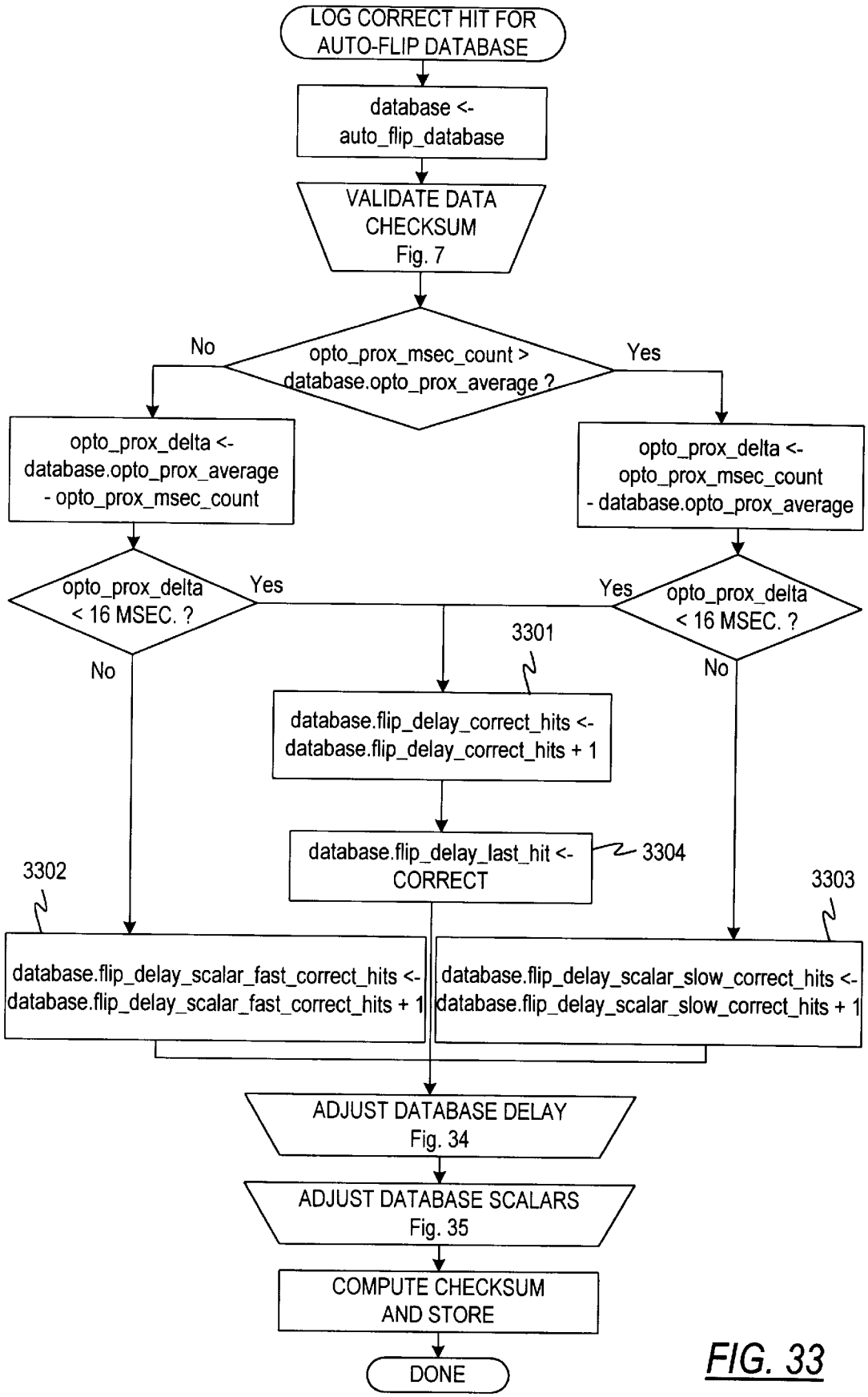

FIG. 33 illustrates the logic flow for logging a correct hit into a shot database. This hit is one in which the flip delay time calculated resulted in a flip that was correct for the intended target. It is similar to FIG. 31; the major differences are at 3301, 3302, 3303, and 3304. At 3301, 3202, and 3203, the database member variables that are modified are the ones that pertain to "correct" hits. Also, at 3301 there is no check for the previous hit; the database member is simply incremented at 3301, and the previous hit is set to 'CORRECT' at 3304, indicating that the last known hit for this shot was "correct".

Figure 34:
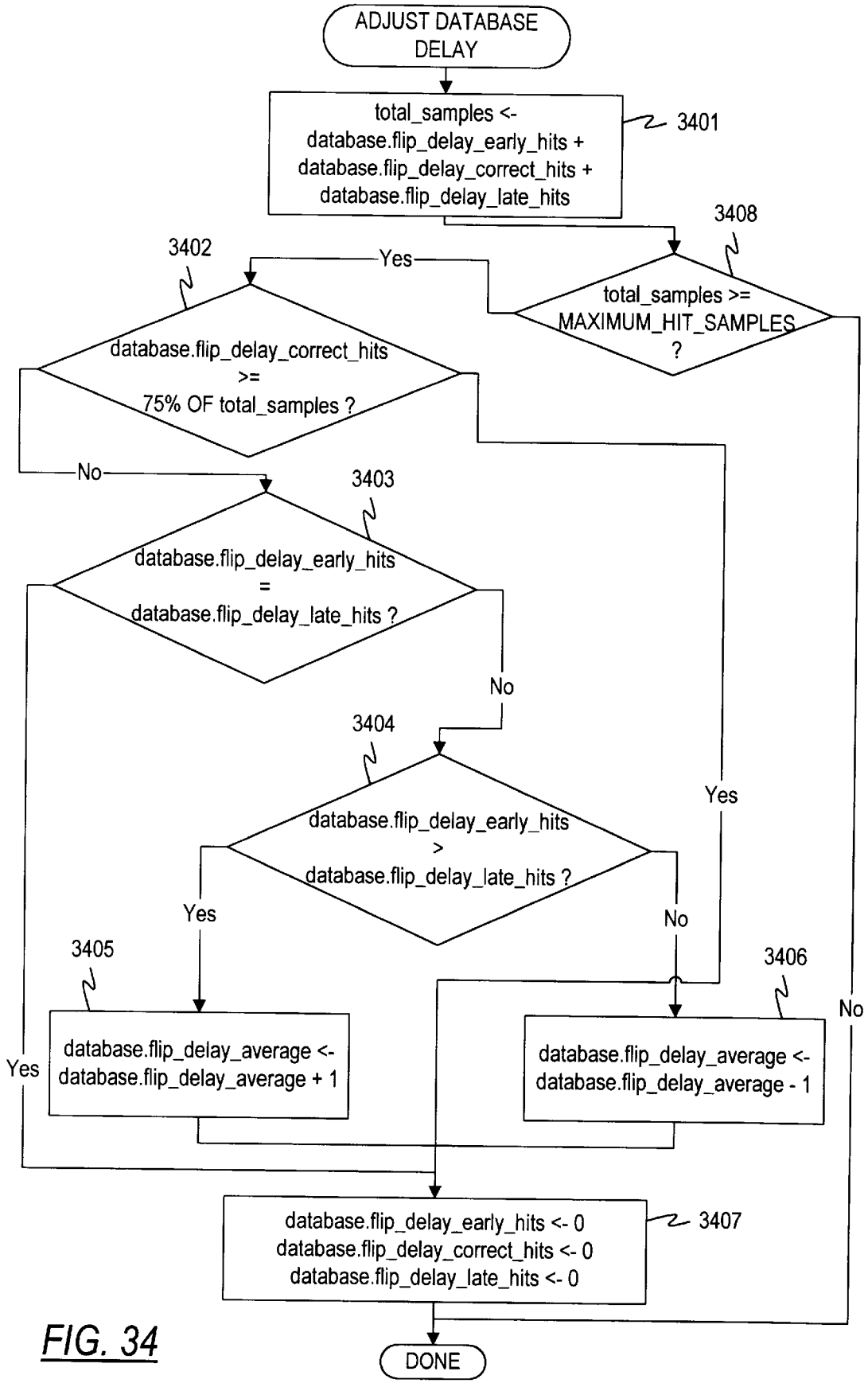

The subroutine for adjusting the database delay in FIG. 34 is called whenever 'flip_delay_early_hits', 'flip_delay_correct_hits', or 'flip_delay_late_hits' are modified in FIGS. 31, 32, or 33. This routine is used to adjust the 'flip_delay' database member variable appropriately if it is determined that the majority of the hits are either "early" or "late". At 3401, the total number of early, correct, and late hits for the database is computed. If the total number of samples (the result of the sum) is less than 'MAXIMUM_HIT_SAMPLES' (4) at 3408, the routine ends. If there are 4 or more samples at 3408, then a check is made at 3402 to see what percentage of the total number of hits are correct hits. If the total number of correct hits account for 75% or more of the total samples, it is not necessary to adjust the flip delay at all; the routine clears the "early", "correct", and "late" hit database member variables at 3407 and exits. For other percentages, it may be necessary to adjust the flip delay. A check is made at 3403 to see whether the number of "early" hits is equal to the number of "late" hits. In this case, it is questionable whether the delay should be increased or decreased. If the "early" and "late" hits are equal, the routine clears the "early", "correct", and "late" hit database member variables at 3407 and exits. If the hits are not equal, it is determined whether the majority of the hits are "early" or "late" at 3404 and the delay is adjusted appropriately. If there are more "early" hits than "late" hits, then 'flip_delay' is too small and the flip delay is increased at 3405. If there are more "late" hits than "early" hits, then 'flip_delay' is too large and the flip delay is decreased at 3406. Once the flip delay has been adjusted, the routine clears the "early", "correct", and "late" hit database member variables at 3407, and exits.

Figure 35:
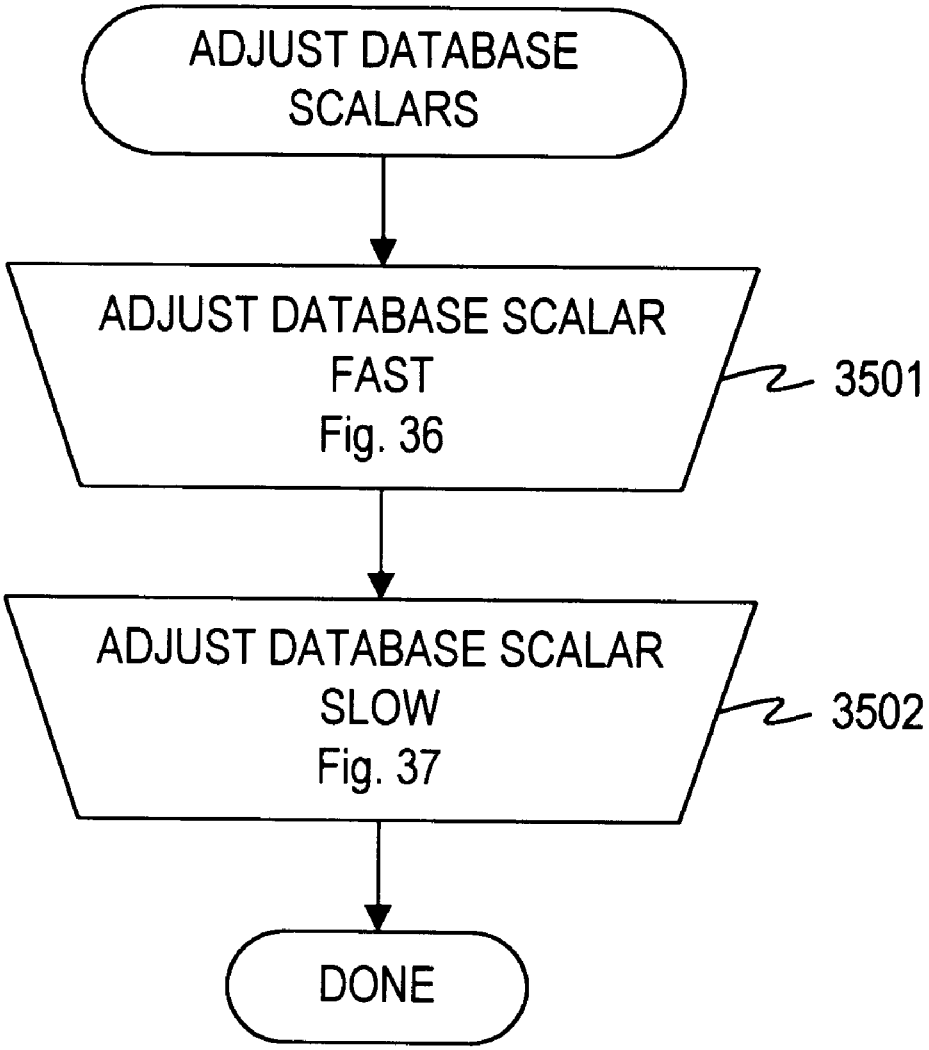

FIG. 35 handles the adjustment of the fast and slow scalars. Two subroutines are called: one to adjust the value of the fast scalar at 3501, and one to adjust the value of the slow scalar at 3502.

Figure 36:
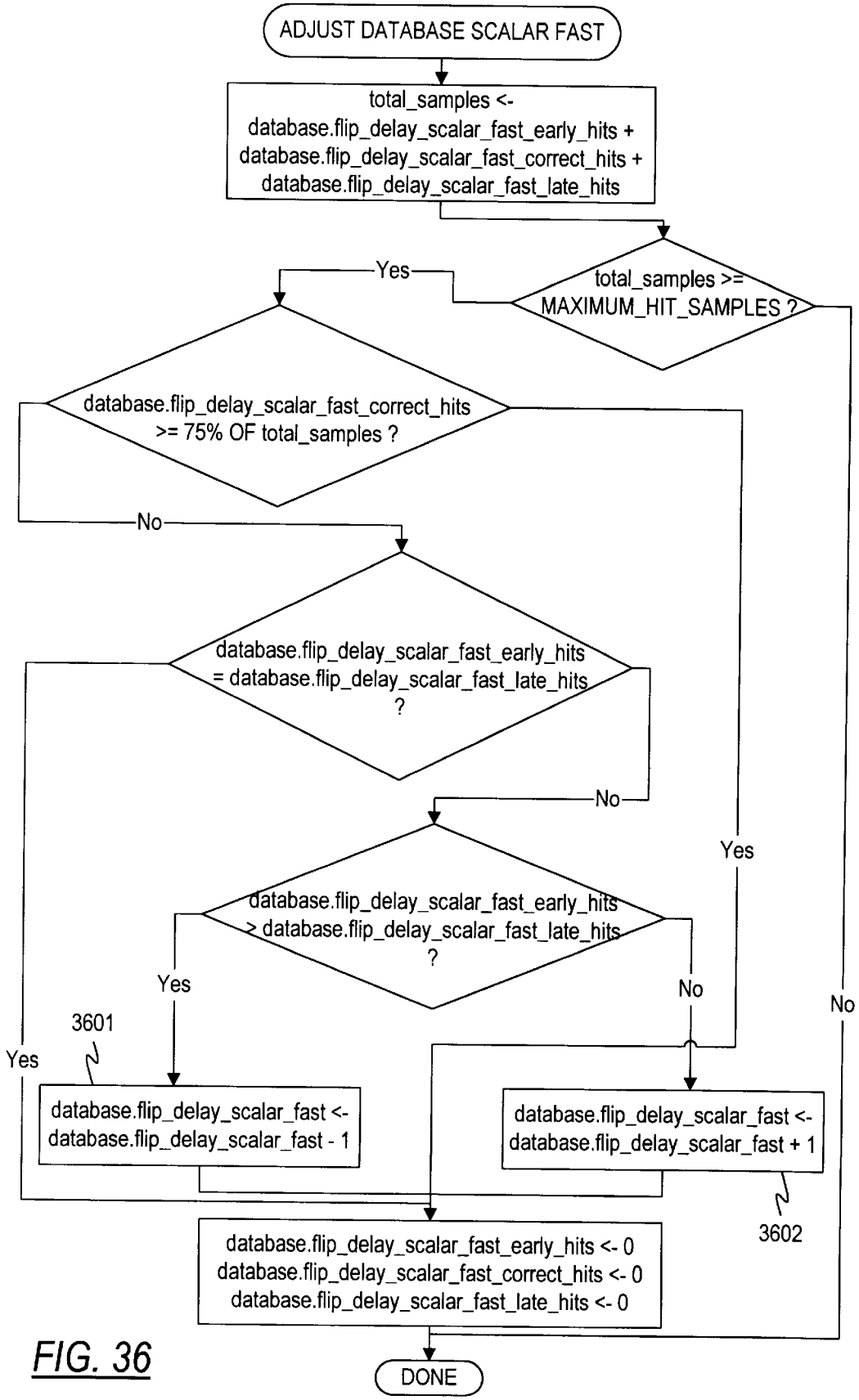

The subroutine for adjusting the database fast scalar in FIG. 36 is called whenever 'flip_delay_scalar_fast_early_hits', 'flip_delay_scalar_fast_correct_hits', or 'flip_delay_scalar_fast_late_hits' are modified in FIGS. 31, 32, or 33. This routine is used to adjust the 'flip_delay_scalar_fast' database member variable appropriately if it is determined that the majority of the hits are either "early" or "late". This subroutine is similar to the one for adjusting the flip delay in FIG. 34. If the majority of the misses are "early", then 'flip_delay_scalar_fast' is too large and the fast scalar is decreased at 3601. If the majority of the misses are "late", then 'flip_delay_scalar_fast' is too small and the fast scalar is increased at 3602.

Figure 37:
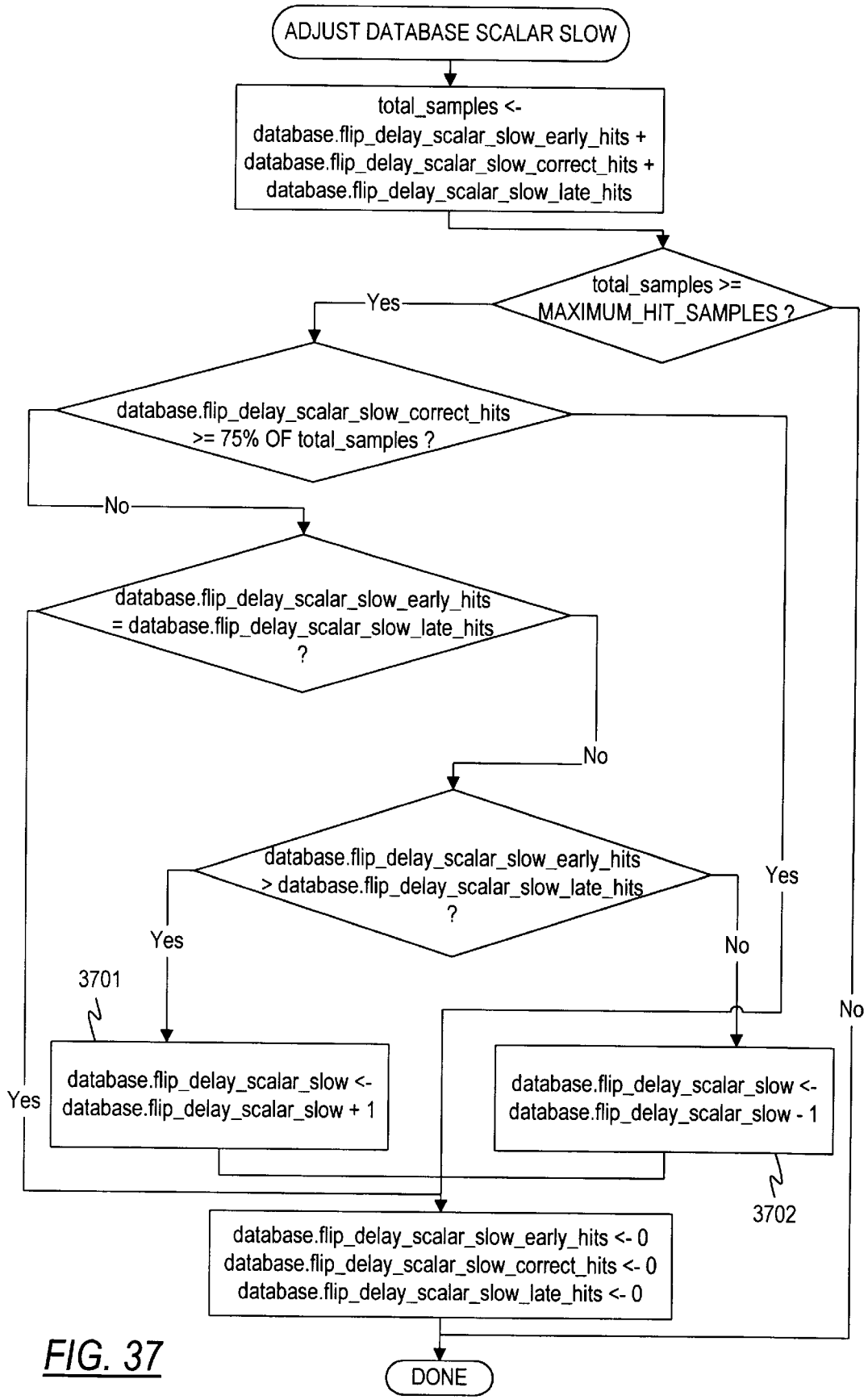

The subroutine for adjusting the database slow scalar in FIG. 37 is called whenever 'flip_delay_scalar_slow_early_hits', 'flip_delay_scalar_slow_correct_hits', or 'flip_delay_scalar_slow_late_hits' are modified in FIGS. 31, 32, or 33. This routine is used to adjust the 'flip_delay_scalar_slow' database member variable appropriately if it is determined that the majority of the hits are either "early" or "late". This subroutine is similar to the one for adjusting the flip delay in FIG. 34. If the majority of the misses are "early", then 'flip_delay_scalar_slow' is too small and the slow scalar is increased 3701. If the majority of the misses are "late", then 'flip_delay_scalar_slow' is too large and the slow scalar is decreased at 3702.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following

What is claimed is:

1. An automatic propelling feature for a pinball game having a playfield supporting a rolling ball and a target thereon, said propelling feature comprising:

ball propelling means, to be mounted to said playfield, for propelling said ball toward said target;

guide means, to be mounted to said playfield, for guiding said ball to said ball propelling means;

sensor means for detecting said ball along said guide means; and processor means, responsive to said sensor means, for recording initial timing samples in a memory in response to said ball passing through said guide means and being accurately propelled by said ball propelling means, operated by a player, toward said target;

wherein in response to said timing samples being recorded in said memory for said target, said processor means operates said ball propelling means based at least partially on said recorded timing samples and attempts to propel said ball toward said target in response to said ball passing through said guide means.

2. The feature of claim 1, wherein said ball propelling means includes a flipper.

3. The feature of claim 1, wherein said sensor means includes first, second, and third sensors, said first sensor being located near an entrance to said guide means to detect that said ball has entered said guide means, said third sensor being located near said ball propelling means, said second sensor being located between said first and third sensors.

4. The feature of claim 3, wherein said first sensor includes a rollover switch, said second sensor includes an optical switch, and said third sensor includes a proximity switch.

5. The feature of claim 3, wherein said processor means, responsive to said second and third sensors, calculates a velocity of said ball through said guide means as said ball approaches said ball propelling means and a time delay between said third sensor detecting said ball and said ball propelling means being operated, said timing samples including said velocity and said time delay.

6. The feature of claim 1, wherein said processor means, responsive to said sensor means, calculates a velocity of said ball through said guide means as said ball approaches said ball propelling means and a time delay between said sensor means detecting said ball near said ball propelling means and said ball propelling means being operated, said timing samples including said velocity and said time delay.

7. The feature of claim 6, wherein said processor means selectively alters the time delay at which said processor means operates said ball propelling means in response to said ball passing through said guide means and approaching said ball propelling means at a velocity different from an average velocity calculated from said timing samples.

8. The feature of claim 6, wherein said processor means selectively alters the time delay at which said processor means operates said ball propelling means in response to said ball passing through said guide means and being propelled toward but missing said target.

9. An automatic flipper feature for a pinball game having a playfield supporting a rolling ball and a target thereon, said flipper feature comprising:

a flipper, to be mounted to said playfield, for propelling said ball toward said target;

a ball guide for guiding said ball to said flipper;

one or more sensors for detecting said ball along said ball guide; and processor means, responsive to said sensors, for recording initial timing samples in a memory in response to said ball passing through said ball guide and being accurately propelled by said flipper, operated by a player, toward said target;

wherein in response to said timing samples being recorded in said memory for said target, said processor means operates said flipper based at least partially on said recorded timing samples and attempts to propel said ball toward said target in response to said ball passing through said ball guide.

10. An automatic propelling feature for a pinball game having a playfield supporting a rolling ball and a plurality of targets thereon, said propelling feature comprising:

ball propelling means, to be mounted to said playfield, for propelling said ball toward said targets;

guide means, to be mounted to said playfield, for guiding said ball to said ball propelling means;

sensor means for detecting said ball along said guide means; and processor means, responsive to said sensor means, for selectively operating said ball propelling means determining which of said plurality of targets are qualifying targets selecting one of said qualifying targets and attempting to propel said ball toward said selected one of said qualifying targets in response to said ball passing through said guide means.

11. The feature of claim 10, wherein said processor means operates said ball propelling means and attempts to propel said ball toward said selected one of said qualifying targets in response to recording in a memory a predetermined number of timing samples associated with said ball passing through said ball guide means and being accurately propelled by said ball propelling means toward said selected one of said qualifying targets.

12. The feature of claim 10, wherein said processor means operates said ball propelling means and attempts to propel said ball toward said selected one of said qualifying targets in response to recording in a memory a predetermined number of timing samples associated with said ball passing through said ball guide means and being accurately propelled by said ball propelling means toward said selected one of said qualifying targets when said ball propelling means is operated by a player.

13. The feature of claim 10, wherein for each of said qualifying targets, said processor means has previously recorded in a memory a predetermined number of timing samples associated with said ball passing through said ball guide means and being accurately propelled by said ball propelling means, operated by a player, toward said qualifying target.

14. The feature of claim 10, wherein said selected one of said qualifying targets toward which said ball is propelled by said processor-operated ball propelling means is selected by said processor means from among said qualifying targets based on which of said qualifying targets, if hit, will yield a highest benefit to a player of the pinball game.

15. The feature of claim 14, wherein said highest benefit is based on a plurality of factors including a score yielded by hitting each target.

16. An automatic flipper feature for a pinball game having a playfield supporting a rolling ball and a plurality of targets thereon, said flipper feature comprising:

a flipper, to be mounted to said playfield, for propelling said ball toward said targets;

a ball guide, to be mounted to said playfield, for guiding said ball to said flipper;

one or more sensors for detecting said ball along said ball guide; and processor means, responsive to said plurality of sensors, for selectively operating said flipper, determining which of said plurality of targets are qualifying targets, selecting one of said qualifying targets, and attempting to propel said ball toward said selected one of said qualifying targets in response to said ball passing through said ball guide.

17. The feature of claim 16, wherein said processor means operates said flipper and attempts to propel said ball toward said selected one of said qualifying targets in response to recording in a memory a predetermined number of timing samples associated with said ball passing through said ball guide and being accurately propelled by said flipper toward said selected one of said qualifying targets when said flipper is operated by a player.

18. The feature of claim 16, wherein for each of said qualifying targets, said processor means has previously recorded in a memory a predetermined number of timing samples associated with said ball passing through said ball guide and being accurately propelled by said flipper, operated by a player, toward said qualifying target.

19. The feature of claim 16, wherein said selected one of said qualifying targets toward which said ball is propelled by said processor-operated flipper is selected by said processor means from among said qualifying targets based on which of said qualifying targets, if hit, will yield a highest benefit to a player of the pinball game.

20. The feature of claim 19, wherein said highest benefit is based on a plurality of factors including a score yielded by hitting each target.

21. A method for automatically operating a ball propelling member of a pinball game having a playfield supporting a rolling ball and a target thereon, said method comprising:

guiding said ball to said ball propelling member;

sensing said ball as said ball is guided to said ball propelling member;

providing a processor including memory for controlling operation of the game;

recording initial timing samples in said memory in response to said ball being guided to said ball propelling member, sensed as said ball is guided to said propelling member, and accurately propelled by said ball propelling member, operated by a player, toward said target; and permitting said processor to operate said ball propelling member based at least partially on said recorded timing samples and attempt to propel said ball toward said target in response to said timing samples being recorded in said memory for said target.

22. The method of claim 21, wherein said timing samples include a velocity of said ball as said ball is guided to said ball propelling member and a time delay between said ball being sensed near said ball propelling member and said ball propelling member being operated.

23. The method of claim 22, further including the step of selectively altering the time delay at which said processor operates said ball propelling member in response to said ball being guided to said ball propelling member at a velocity different from an average velocity calculated from said timing samples.

24. The method of claim 22, further including the step of selectively altering the time delay at which said processor operates said ball propelling member in response to said ball being guided to said ball propelling member and being propelled toward but missing said target.

25. A method for automatically operating a ball propelling member of a pinball game having a playfield supporting a rolling ball and a plurality of targets thereon, said method comprising:

guiding said ball to said ball propelling member;

sensing said ball as said ball is guided to said ball propelling member;

providing a processor including memory for controlling operation of the game; and in response to guiding said ball to said ball propelling member and sensing said ball as said ball is guided to said ball propelling member, using said processor to selectively operate said ball propelling member, determine which of said plurality of targets are qualifying targets select one of said qualifying targets, and attempt to propel said ball toward said selected one of said qualifying targets.

26. The method of claim 25, wherein prior to said step of using said processor to selectively operate said ball propelling member, further including the step of recording in said memory for each of said qualifying targets a predetermined number of timing samples associated with said ball being guided to said ball propelling member and accurately propelled by said ball propelling member, operated by a player, toward said qualifying target.

27. The method of claim 26, wherein the step of selecting said one of said qualifying targets is based on which of said qualifying targets, if hit, will yield a highest benefit to the player of the pinball game.

28. A method for automatically operating a ball propelling member of a pinball game having a playfield supporting a rolling ball and a plurality of targets thereon, said method comprising:

guiding said ball to said ball propelling member;

sensing said ball as said ball is guided to said ball propelling member;

under the control of a game processor, recording for each of said targets a predetermined number of timing samples associated with said ball being guided to said ball propelling member and accurately propelled by said ball propelling member toward said targets;

selecting one of said targets for which said predetermined number of timing samples have been recorded; and propelling said ball toward said selected one of said targets.

* * * * *